US010881572B2

(12) United States Patent
Tholkes et al.

(10) Patent No.: US 10,881,572 B2
(45) Date of Patent: Jan. 5, 2021

(54) NATURAL ASSIST SIMULATED GAIT THERAPY ADJUSTMENT SYSTEM

(71) Applicant: ALT Innovations LLC, Prior Lake, MN (US)

(72) Inventors: Alan Tholkes, Prior Lake, MN (US); DuWayne Dandurand, Jordan, MN (US)

(73) Assignee: ALT Innovations LLC, Prior Lake, MN (US)

( * ) Notice: Subject to any disclaimer, the term of this patent is extended or adjusted under 35 U.S.C. 154(b) by 47 days.

(21) Appl. No.: 16/381,800

(22) Filed: Apr. 11, 2019

(65) Prior Publication Data

US 2019/0231630 A1 Aug. 1, 2019

Related U.S. Application Data

(63) Continuation-in-part of application No. 15/358,613, filed on Nov. 22, 2016, now Pat. No. 10,315,067,
(Continued)

(51) Int. Cl.
*A61H 1/02* (2006.01)
*A61H 1/00* (2006.01)

(52) U.S. Cl.
CPC ..... *A61H 1/02* (2013.01); *A61H 1/00* (2013.01); *A61H 1/024* (2013.01); *A61H 1/0266* (2013.01);
(Continued)

(58) Field of Classification Search
CPC . A63B 22/0002; A63B 22/02; A63B 22/0292; A63B 22/0664; A63B 23/03566;
(Continued)

(56) References Cited

U.S. PATENT DOCUMENTS 5,242,179 A 9/1993 Beddome et al.
6,689,075 B2 * 2/2004 West ..... A61F 5/0102 482/69
(Continued)

FOREIGN PATENT DOCUMENTS

AU 2014361932 B2 6/2015
CA 2938531 A1 6/2015
(Continued)

OTHER PUBLICATIONS

International Search Report and Written Opinion in related International Application No. PCT/US2014/063487; dated Feb. 19, 2015; 12 pages.
(Continued)

*Primary Examiner* — Joshua Lee
(74) *Attorney, Agent, or Firm* — Craige Thompson; Thompson Patent Law

(57) ABSTRACT

Apparatus and associated methods relate to a natural gait therapy device having an adjustable gait timing linkage assembly configured to operate an adjustable knee support assembly and an adjustable height foot assembly to simulate a normal walking pattern for a user based on characteristics of the user. In an illustrative example, the adjustable gait timing linkage assembly includes a chain sprocket configured to adjust a degree of heel lift and a length to the point of the heel lift during a normal walking simulation. In some embodiments, a gait stride adjustment assembly may adjust a stride length to accommodate different sized users. The gait stride adjustment assembly may advantageously contribute to the natural walking pattern simulation.

18 Claims, 19 Drawing Sheets

Related U.S. Application Data which is a continuation-in-part of application No. 14/529,568, filed on Oct. 31, 2014, now Pat. No. 9,616,282.

(60) Provisional application No. 62/374,383, filed on Aug. 12, 2016, provisional application No. 61/915,834, filed on Dec. 13, 2013.

(52) U.S. Cl.
CPC ..... *A61H 2201/0192* (2013.01); *A61H 2201/1207* (2013.01); *A61H 2201/1436* (2013.01); *A61H 2201/1621* (2013.01); *A61H 2201/1626* (2013.01); *A61H 2203/0406* (2013.01); *A61H 2203/0431* (2013.01)

(58) Field of Classification Search
CPC ..... A63B 71/0009; A63B 2022/0647; A63B 2022/0676; A63B 2208/0204; A63B 2208/0233; A63B 2225/093; A61H 2003/005; A61H 3/00; A61H 3/008; A61H 1/005; A61H 1/0237; A61H 1/0262; A61H 1/0266; A61H 2001/027
USPC ..... 601/5, 35
See application file for complete search history.

(56) References Cited

U.S. PATENT DOCUMENTS 6,770,040 B2 * 8/2004 Perner ..... A61F 5/0102 482/124
6,821,233 B1 * 11/2004 Colombo ..... A61F 5/0102 482/54
7,163,492 B1 * 1/2007 Sotiriades ..... A61H 1/0237 482/51
7,601,104 B2 * 10/2009 Agrawal ..... A61G 5/14 482/69
7,833,134 B2 11/2010 Gordon
7,938,756 B2 * 5/2011 Rodetsky ..... A61H 3/04 482/69
8,177,688 B2 * 5/2012 Burnfield ..... A63B 21/4015 482/7
8,454,541 B2 * 6/2013 Olsen ..... A61H 3/008 601/34
8,771,208 B2 * 7/2014 Agrawal ..... A61H 1/0255 601/35
9,161,872 B2 * 10/2015 Lee ..... A61G 7/1015
2002/0026130 A1 * 2/2002 West ..... A61H 1/0262 601/23
2004/0097330 A1 * 5/2004 Edgerton ..... A61H 1/0262 482/1
2004/0102291 A1 5/2004 Eschenbach
2004/0116839 A1 * 6/2004 Sarkodie-Gyan ..... A61H 3/008 601/35
2005/0101448 A1 * 5/2005 He ..... A63B 22/02 482/54
2006/0097557 A1 * 5/2006 Tholkes ..... A61G 5/14 297/330
2007/0179561 A1 * 8/2007 Embrey ..... A61N 1/36003 607/49
2008/0051258 A1 * 2/2008 Schmehl ..... A63B 22/0015 482/52
2008/0255488 A1 * 10/2008 Agrawal ..... A63B 69/0064 602/23
2009/0298653 A1 12/2009 Rodetsky et al.
2010/0121232 A1 * 5/2010 Sankai ..... A61H 1/0255 601/23
2010/0222716 A1 * 9/2010 Olsen ..... A61H 1/00 601/26
2010/0248903 A1 * 9/2010 Cardile ..... A61H 1/0262 482/51
2010/0270771 A1 * 10/2010 Kobayashi ..... A61H 1/0255 280/210
2010/0285929 A1 * 11/2010 Bayerlein ..... A63B 21/00181 482/54
2010/0298102 A1 * 11/2010 Bosecker ..... A61H 1/0237 482/54
2011/0071442 A1 * 3/2011 Park ..... A61B 5/112 601/35
2011/0086742 A1 * 4/2011 Burnfield ..... A63B 21/4015 482/7
2011/0201978 A1 * 8/2011 Jeon ..... A61G 5/128 601/35
2011/0205067 A1 * 8/2011 Konishi ..... A61H 1/024 340/573.1
2012/0004581 A1 * 1/2012 Dinon ..... A61H 1/0255 601/23
2012/0253242 A1 * 10/2012 Lee ..... A61H 1/0262 601/35
2013/0226048 A1 * 8/2013 Unluhisarcikli ..... A61H 1/00 601/34
2013/0274640 A1 * 10/2013 Butters ..... A61H 3/008 601/35
2015/0165265 A1 6/2015 Tholkes et al.

FOREIGN PATENT DOCUMENTS

EP 3079642 A1 6/2015
WO 2015/088668 A1 6/2015
WO 2018/032007 A1 2/2018

OTHER PUBLICATIONS

Examination Report No. 1 for standard patent application in related Australia Application No. 2014361932; dated Aug. 16, 2018; 3 pages.
Extended European Search Report in related Europe Application No. 14869433.4-1658 / 3079642; dated May 10, 2017; 8 pages.
International Search Report in related International Application No. PCT/US17/46788; dated Nov. 9, 2017; 3 pages.
Written Opinion of the International Searching Authority in related International Application No. PCT/US17146788; dated Nov. 9, 2017; 4 pages.
International Preliminary Report on Patentability in related International Application No. PCT/US2017/046788, dated Feb. 21, 2019, 6 pages.

* cited by examiner

NATURAL ASSIST SIMULATED GAIT THERAPY ADJUSTMENT SYSTEM

CROSS-REFERENCE TO RELATED APPLICATIONS

This application is a Continuation-in-Part and claims the benefit of U.S. application Ser. No. 15/358,613, titled "Natural Assist Simulated Gait Therapy Adjustment System," filed by Alan Tholkes, et al. on Nov. 22, 2016, which claims the benefit of U.S. Provisional Application Ser. No. 62/374,383 titled "Natural Assist Simulated Gait Therapy Adjustment System," filed by Alan Tholkes, et al on Aug. 12, 2016, and is a Continuation-in-Part and claims the benefit of U.S. application Ser. No. 14/529,568 titled "Multi-Modal Gait-Based Non-Invasive Therapy Platform," filed by Alan Tholkes, et al. on Oct. 31, 2014, which claims the benefit of U.S. Provisional Application Ser. No. 61/915,834 titled "Natural-Gait Therapy Device," filed by Alan Tholkes, et al. on Dec. 13, 2013.

The entirety of the foregoing application(s) are hereby incorporated by reference.

TECHNICAL FIELD

Various embodiments relate generally to therapy devices, and more specifically to therapy devices for people with spinal cord injuries.

BACKGROUND

There are approximately twelve thousand spinal cord injuries (SCI) per year in the United States alone. The average age of an injured person is twenty-eight years old. There are approximately three-hundred thousand people with SCIs in wheelchairs in the United States. In addition to SCIs, there are also many thousands of cases of strokes as well as thousands of cases of MS diagnoses each year in the United States. Furthermore, many other neurological problems afflict people and confine them to wheelchairs. The numbers of such cases world-wide is commensurately larger yet.

Providing such physically afflicted individuals an ability to stand may help maintain and improve their health. Walking therapy may restore function in SCI individuals and in those who have suffered paralyzing strokes. The beneficial results from walking therapy may be enhanced if the paralyzed individual can consistently and regularly perform the therapy. Mental health benefits may accrue as well to SCI individuals who may independently exercise or practice therapy.

SUMMARY

Apparatus and associated methods relate to a natural gait therapy device having an adjustable gait timing linkage assembly configured to operate an adjustable knee support assembly and an adjustable height foot assembly to simulate a normal walking pattern for a user based on characteristics of the user. In an illustrative example, the adjustable gait timing linkage assembly includes a chain sprocket configured to adjust a degree of heel lift and a length to the point of the heel lift during a normal walking simulation. In some embodiments, a gait stride adjustment assembly may adjust a stride length to accommodate different sized users. The gait stride adjustment assembly may advantageously contribute to the natural walking pattern simulation.

Various embodiments may achieve one or more advantages. For example, some embodiments may include a hand crank to assist with the walking pattern. A user may operate the hand crank via hand grips that provide rotational motion. The hand grips may be positioned such that the rotational motion simulates a natural swaying of the arms of a user during operation of the hand crank. A pair of swing arms may operate the hand crank. The swing arms may be positioned such that a user may push/pull the swing arms to operate the hand crank.

The adjustable gait timing linkage assembly may operably connect to a motor module. The motor module may assist a user walking during an operation of the natural gait therapy device. The motor module may include smart features. For example, the motor may have a controller module operably coupled to a sensor that detects muscle spasms. In response to a detected muscle spasm, the controller may terminate operations of the natural gait therapy device.

The natural gait therapy device may include an elevation subsystem arranged such that a user may mount the natural gait therapy device from a sitting position (e.g., from a wheelchair). Once in the natural gait therapy device, the user may raise, via the elevation subsystem, a seat of the natural gait therapy device such that the user goes from a sitting position to a standing position. Advantageously, the user may transfer to and from the natural gait therapy device without any assistance. The user may also go from a sitting position to a standing position without any assistance.

The details of various embodiments are set forth in the accompanying drawings and the description below. Other features and advantages will be apparent from the description and drawings, and from the claims.

BRIEF DESCRIPTION OF THE DRAWINGS

Like reference symbols in the various drawings indicate like elements.

DETAILED DESCRIPTION OF ILLUSTRATIVE EMBODIMENTS

Figure 1:
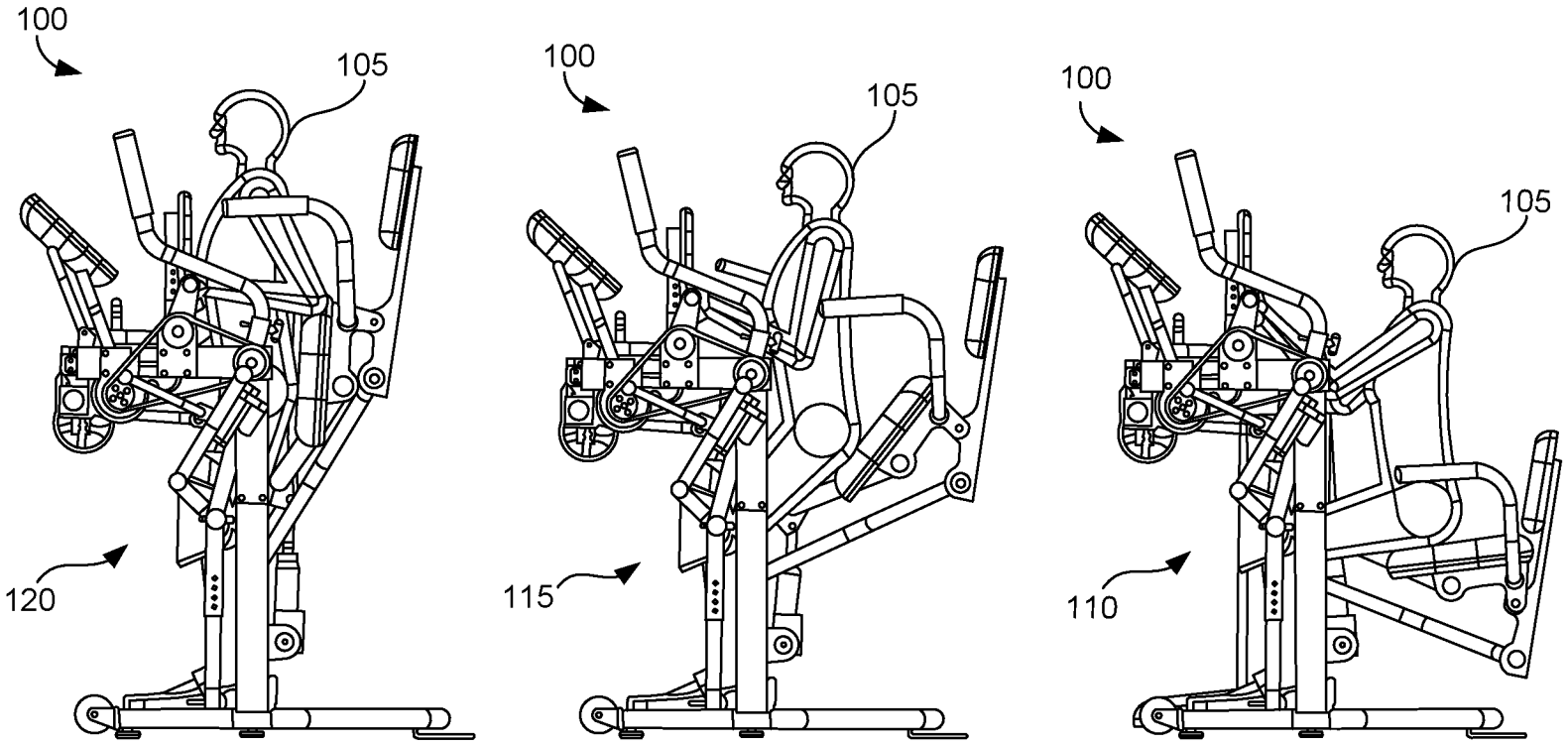
FIG. 1 depicts a side view of a sequence of different stages of an exemplary natural assist simulated gait therapy adjustment system (NASGTAS).

FIG. 1 depicts a side view of a sequence of different stages of an exemplary natural assist simulated gait therapy adjustment system (NASGTAS). In FIG. 1, a user 105 is in a sitting position 110 in a natural assist simulated gait therapy adjustment system (NASGTAS) 100. The user 105 activates a sit-to-stand subsystem (described below in further detail in FIG. 2) to lift 115 the user 105 from the sitting position 110 to a standing position 120. Such sit-to-stand subsystems are described, for example, in FIGS. 2A-2D and at least at [0033], of the U.S. Provisional Application Ser. No. 61/915,834 titled "Natural-Gait Therapy Device," filed by Alan Tholkes, et al., on Dec. 13, 2013, the entire disclosure of which is hereby incorporated by reference.

The NASGTAS 100 includes a gait simulating engine (GSE) (described below in further detail in FIG.2) to accommodate a stride length of the user 105. As such, the NASGTAS 100 may accommodate stride lengths for different sized users.

Figure 2:
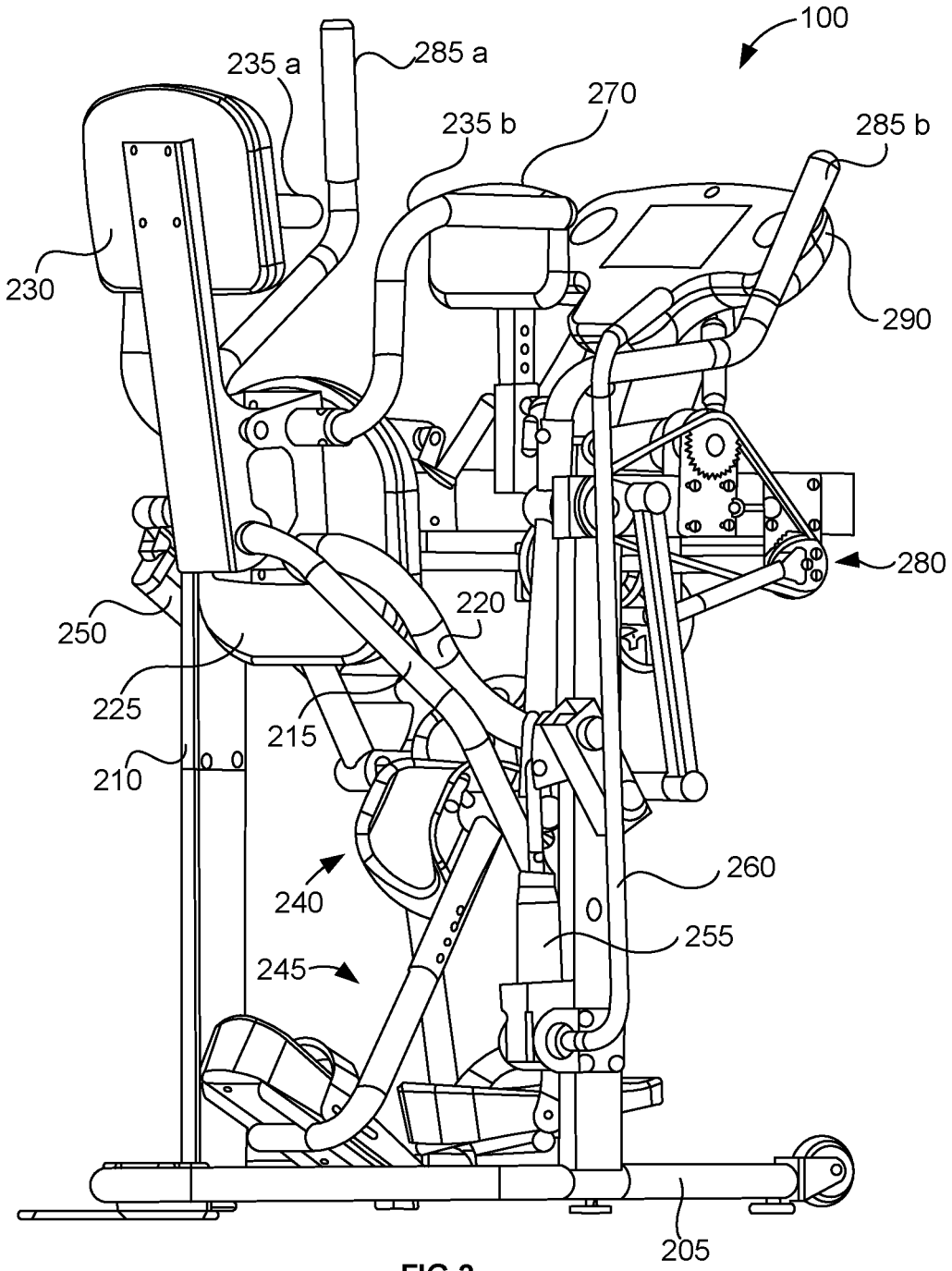
FIG. 2 depicts a back-perspective view of an exemplary NASGTAS.

FIG. 2 depicts a back-perspective view of an exemplary NASGTAS. The NASGTAS 100 includes a V-shaped base 205 adapted to permit the user 105 to transfer from a chair (e.g., wheelchair) into the NASGTAS 100. The V-shaped base 205 releasably couples to an upper frame 210 to form a chassis of the NASGTAS 100. A pair of elevation adjustment arms 215, 220 pivotably connect to the upper frame 210. The elevation adjustment arm 215 pivotably attaches to a seat 225 and a backrest 230 while the elevation adjustment arm 220 pivotably attaches to the seat 225. A pair of arm rests 235*a*-235*b* pivotably attach to the seat 225. A pair of leg movement subsystems 240-245 operably attach to the chassis such that a mode adjustment subsystem 250 positions the leg movement subsystems 240-245 in accordance with a preference of the user 105. As depicted, the mode adjustment subsystem 250 includes an actuator to extend and retract a telescoping member to determine a standing mode or a walking mode. In various embodiments, the mode adjustment subsystem 250 may be operated via an electrical button to permit the user 105 to easily change between modes. The mode adjustment subsystem 250 may be operated via a mechanical lever. The mode adjustment subsystem 250 may include a hydraulic actuator or an electric actuator, for example.

An elevation actuator 255 operably attaches to the elevation adjustment arm 215. An elevation lever 260 operably attaches to the elevation actuator 255 such that the user 105 may operate the elevation lever 260 to cause the elevation actuator 255 to alter the elevation of the elevation adjustment arm 220. When the user 105 causes, via the elevation lever 260, the elevation actuator 255 to lift the elevation adjustment arm 220, for example, the elevation adjustment arm 220 raises the seat 225 such that the seat 225 pivots about the elevation adjustment arm 220 to a substantially orthogonal position relative to the seat 225 at the sitting position 110. In response to the seat 225 being raised, the elevation adjustment arm 215 raises the back rest 230 while the back rest 230 substantially maintains the same orientation, unlike the seat 225. The arm rests 235*a*-235*b* may pivot to substantially maintain the same orientation when raised. A chest pad 270, releasably attached to the upper frame 210, may prevent the user 105 from falling forward onto the NASGTAS 100. The chest pad 270 may include a telescopic arm to accommodate different sized users. The telescopic arm may include a securing mechanism, such as a securing pin, to prevent the chest pad 270 from moving out of place during operation of the NASGTAS 100.

The NASGTAS 100 includes a gait simulating engine (GSE) 280 releasably attached to the upper frame 210. The GSE 280 operably attaches to the leg movement subsystems 240-245. The GSE 280 includes a dual-chain drive subsystem (described in further detail below, in FIG. 3) connected to each other via a flywheel subsystem (described in further detail below, in FIG. 3). The GSE 280, via the chain drive subsystem, may operate the leg movement subsystems 240-245 to simulate a natural gait of the user 105.

A pair of arm swing levers 285*a*-285*b* operably attach to the GSE 280. Each arm swing lever 285*a*-285*b*, operably connects to the leg movement subsystem 240, 245, respectively. The pair of arm swing levers 285*a*-285*b* may operate via a pull-push movement to operate the GSE 280 and the pair of leg movement subsystems 240-245. As such, the user 105 may control a velocity of the NASGTAS 100 in accordance with a preference of the user 105.

The NASGTAS 100 includes an electronic console 290, such as a portable electronic device, for example. The electronic console 290 may include a camera to transmit real-time video to a third party. The electronic console 290 may include a networking module to connect to a network (e.g., Internet). A software application may reside on the electronic console 290 to collect therapy data from sensors placed on or about the NASGTAS 100. The electronic console may transmit, and receive, data to/from a remote location (e.g., remote database) from which a third party (e.g., doctor) may access the data. A computer at the remote location may compile a history of therapy data for the user 105. The history of therapy data may reside locally on the electronic console 290 or at the remote location.

Figure 3:
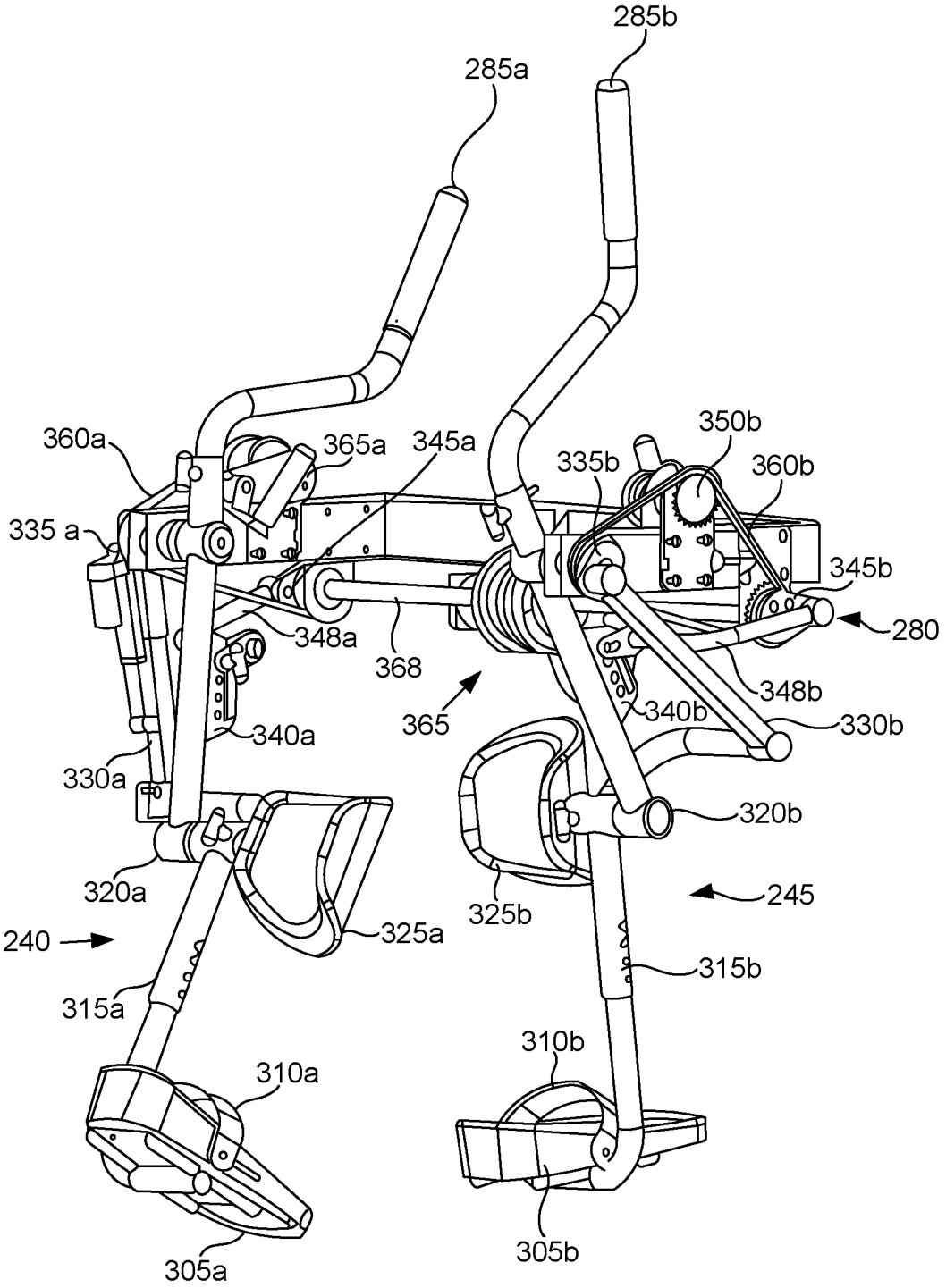
FIG. 3 depicts a perspective view of an exemplary gait simulating engine (GSE) connected to leg support subsystems.

FIG. 3 depicts a perspective view of an exemplary gait simulating engine (GSE) connected to leg support subsystems. The gait simulating engine (GSE) 280 operably attaches to the leg movement subsystems 240-245. Each leg movement subsystem 240-245 includes a foot rest 305*a*-305*b*, respectively. Each foot rest 305*a*-305*b* includes an adjustable foot strap 310*a*-310*b*, respectively. The foot straps may ensure that the user's 105 feet are properly positioned within the foot rests 305*a*-305*b*. The foot rests 305*a*-305*b* attach to lower leg members 315*a*-315*b*. The lower leg members 315*a*-315*b* pivotably connect to the arm swing levers 285*a*-285*b*, respectively, via a pivot joint 320*a*-320*b*. As depicted, the lower leg members 315*a*-315*b* may accommodate different sized users via a telescopic construction. The user 105 may alter the lower leg members 315*a*-315*b* to properly position the knees of the user 105 relative to knee supports 325*a*-325*b*.

The knee supports 325*a*-325*b* pivotably attach to the swing arm levers 285*a*-285*b* and the lower leg members 315*a*-315*b* at the pivot joints 320*a*-320*b*. In various embodiments, the knee supports 325*a*-325*b* may rotate to simulate a natural positioning of a knee during a walking cycle. The rotation of the knee supports may further secure the knees of the user 105 to prevent a displacement of the legs during operation of the NASGATS 100. Drive members 330*a*-330*b* operably attach to the pivot joints 320*a*-320*b*, respectively. Each drive member 330*a*-330*b* operably attaches to the GSE 280 at a drive sprocket 335*a*-335*b*. The GSE 280 may simulate a natural gait movement via a motor (described in further detail below, in FIG. 4A) or assist a user using a manual driver system, such as, for example, the arm swing levers 285*a*-285*b*. The drive sprockets 335*a*-335*b* operably connect to the arm swing lever 285*a*-285*b*, respectively, such that a push-pull movement applied to the arm swing levers 285*a*-285*b* causes a rotation of the drive sprockets 335*a*-335*b*.

Each arm swing lever 285*a*-285*b* includes an adjustment bracket 340*a*-340*b* that connects the arm swing lever 285*a*-285*b* to a flywheel sprocket 345*a*-345*b* via an adjustable connecting member 348*a*-348*b*. As depicted, the flywheel sprockets 345*a*-345*b* includes an oblong face having a rotating joint to attach to the adjustable connecting member 348*a*-348*b*. A hand crank sprocket 350*b* (350*a* not shown) operably connects to the drive sprocket 335*b* and the flywheel sprocket 345*b* via a chain 360*b*. A flywheel subsystem 365 operably attaches to the flywheel sprockets 345*a*-345*b* via a flywheel shaft 368.

Figure 4A:
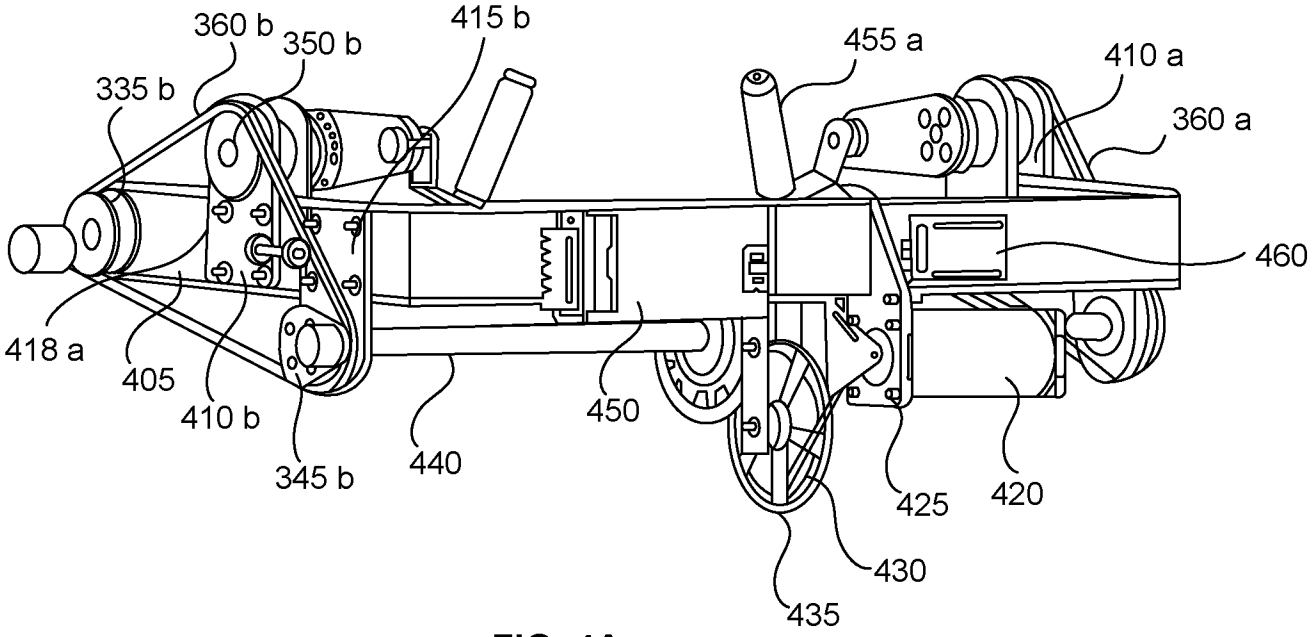
FIG. 4A depicts a right perspective view of an exemplary GSE.

FIG. 4A depicts a right perspective view of an exemplary GSE. The GSE 280 includes drive sprockets 335*a*-335*b*, flywheel sprockets 345*a*-345*b*, and hand crank sprockets 350*a*-350*b*. Each hand crank sprocket 350*a*-350*b* forms a chain drive subsystem with corresponding drive sprockets 335*a*-335*b* and flywheel sprockets 345*a*-345*b*. For example, the hand crank sprocket 350*b* operably connects, via a chain 360*b*, to the drive sprocket 335*b* and the flywheel sprocket 345*b* to form a chain drive subsystem. The chain 360*b*, as depicted, forms a triangular path around the hand crank sprocket 350*b*, the drive sprocket 335*b*, and the flywheel sprocket 345*b*.

The upper frame (FIG. 2, item 210) includes a U-shaped frame 405. The NASGTAS 100 includes a dual chain drive subsystem. Each dual chain subsystem is on an opposing side of the U-shaped frame 405. Each chain drive subsystem mounts to the U-shaped frame 405 such that the chain 360*a*-360*b* resides on an exterior of the U-shaped frame 405. As depicted, the drive sprocket 335*b* mounts directly to the U-shaped frame 405 while the hand crank sprocket 350*b* and the flywheel sprocket 345*b* mount via a frame bracket 410*b*, and a frame bracket 415*b*, respectively. The frame brackets 410*b*, 415*b*, operably connect to each other via a tension mechanism, such as a tension screw, for example. The user 105 may alter the tension of the chain 360*b* by tightening or loosening the tension screw. The dual chain subsystems operably connect to each other via the flywheel subsystem 365.

The GSE 280 includes a motor 420 mounted to the U-shaped frame 405 via a motor mount bracket 425. The motor 420 operably connects to a flywheel assembly 430 via a flywheel chain 435. A flywheel shaft 440 operably connects the flywheel assembly 430 to the flywheel sprockets 345*a*-345*b*. As depicted the flywheel assembly 430 includes a weighted flywheel with multiple pulleys to increase a velocity such that a centrifugal force on the flywheel assembly provides for a smooth walking motion when the user is manually operating the NASGATS. A power source 450 mounts of the U-shaped frame 405. The power source 450 may operably connect to the motor 420 to provide an electrical current, for example. In some embodiments, the power source 450 may operably connect to an electronic console, such as electronic console 290, for example.

A smart control module 460 mounts to the U-shaped frame 405. The smart control module 460 may include a controller that operably connects to various sensors that monitor different characteristics of the user 105 during operation. For example, a touch sensor to detect and monitor a heart rate of the user 105 may be disposed on the swing arm levers 285*a*-285*b* such that the user 105 may efficiently access the touch sensors. In some embodiments, the smart controller may provide real-time information for determining therapy progression or motivation of a user. For example, the smart controller may provide information regarding a percentage of assistance provided by the motor 420. In various embodiments, the smart control module 460 may include the power source 450 to form a single unit.

Figure 4B:
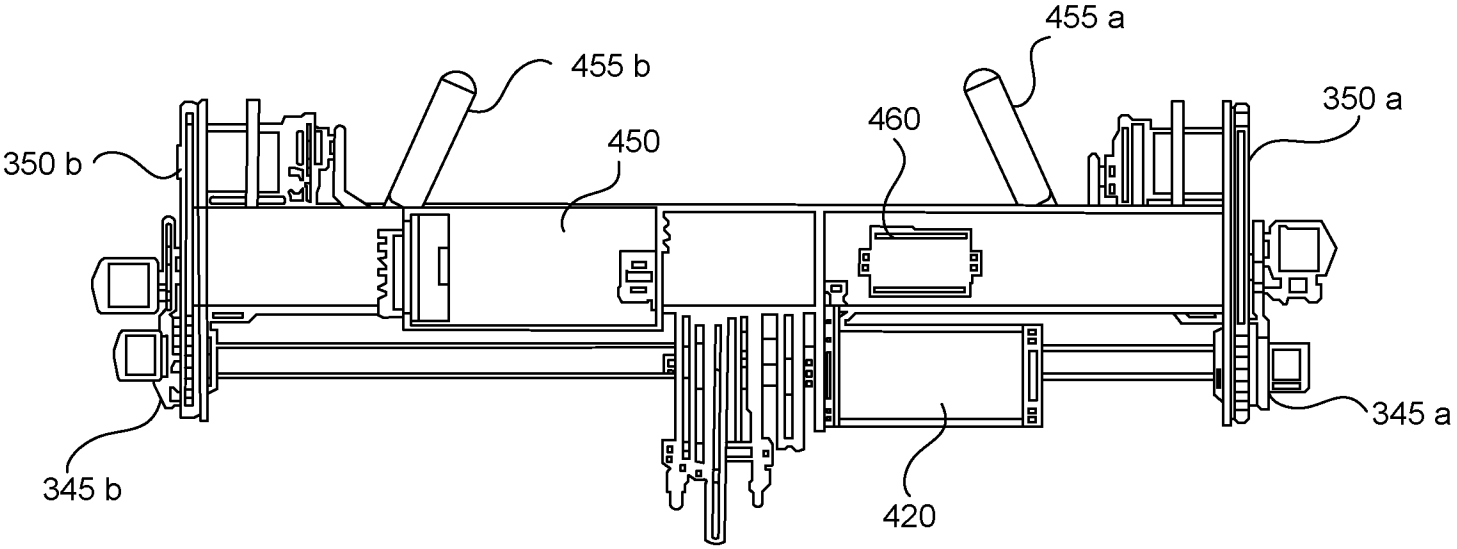
FIG. 4B depicts a front view of an exemplary GSE.

FIG. 4B depicts a front view of an exemplary GSE. As depicted, the motor 420 mounts to the U-shaped frame 405 near the chain drive subsystem formed from the drive sprocket 335*b*, the hand crank sprocket 350*b*, and the flywheel sprocket 345*b*. The smart control module 460 mounts to the U-shaped frame 405 near the chain drive subsystem formed from the drive sprocket 335*a*, the hand crank sprocket 350*a*, and the flywheel sprocket 345*a*. In various embodiments, the motor 420 may mount near the chain drive subsystem formed from the drive sprocket 335*a*, the hand crank sprocket 350*a*, and the flywheel sprocket 345*a*. The smart control module 460 may mount near the chain drive subsystem formed from the drive sprocket 335*b*, the hand crank sprocket 350*b*, and the flywheel sprocket 345*b*.

A hand crank 455*a* attaches to the hand crank sprocket 350*a* via an oblong mounting bracket 465*a*. The hand crank 455*a* pivotably connects to the oblong mounting bracket 465*a*. As such the hand crank 455*a* may substantially retain an orientation of the hand crank 455*a* during operation. Advantageously, by arranging the chain drive subsystem on the exterior of the U-shaped frame 405, the space in the interior of the U-shaped frame 405 opens up to permit hand cranks 455*a*-455*b* to be positioned such that the operation of the hand cranks 455*a*-455*b* simulate a more natural swinging of the arms of the user 105 during operation.

Figure 4C:
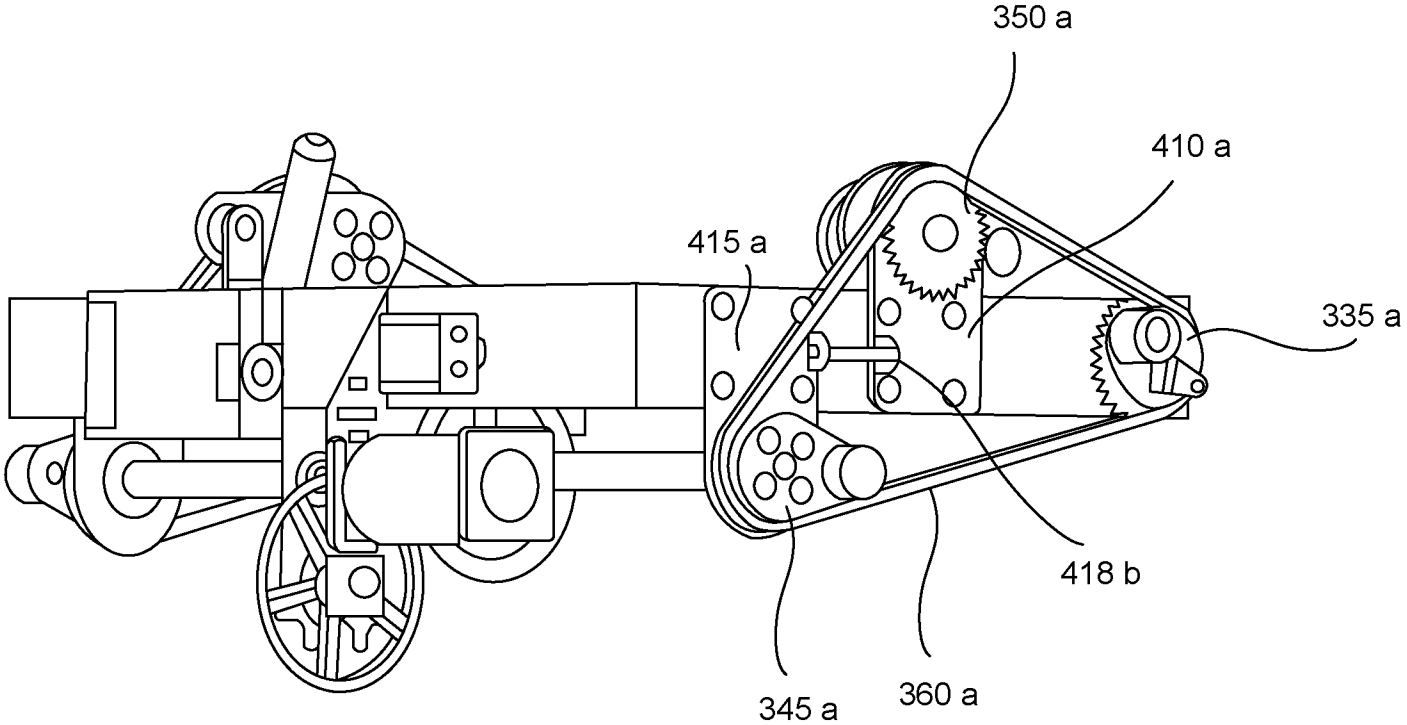
FIG. 4C depicts a left perspective view of an exemplary GSE.

FIG. 4C depicts a left perspective view of an exemplary GSE. The hand crank sprocket 350*a* and the flywheel sprocket 345*a* mount to the U-shaped frame 405 via frame brackets 410*a*, 415*a*, respectively. The drive sprocket 335*a* directly mounts to the U-shaped frame 405. The hand crank sprocket 350*a*, the flywheel sprocket 345*a* and the drive sprocket 335*a* operably connect to each other via the chain 360*a*. As depicted, the chain drive subsystem formed from the drive sprocket 335*a*, the hand crank sprocket 350*a*, and the flywheel sprocket 345*a* mirrors the chain drive subsystem formed from the drive sprocket 335*b*, the hand crank sprocket 350*b*, and the flywheel sprocket 345*b*.

Figure 4D:
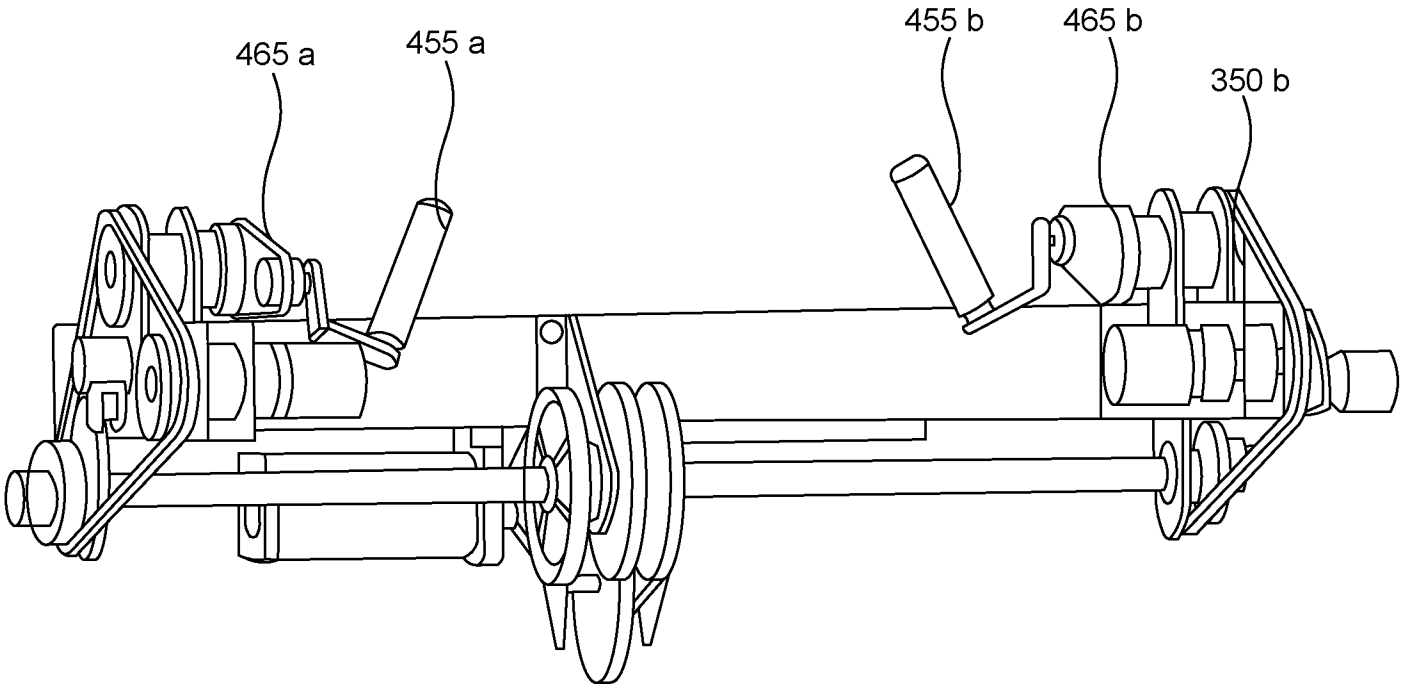
FIG. 4D depicts a back-perspective view of an exemplary GSE.

FIG. 4D depicts a back-perspective view of an exemplary GSE. A hand crank 455*b* attaches to the hand crank sprocket 350*b*. An oblong mounting bracket 465*b* attaches the hand crank 455*b* to the hand crank sprocket 350*b* such that when the hand crank 455*a* is in an upward position, the hand crank 455*b* is in a downward position (as depicted). When the hand crank 455*a* rotates downward, for example, by a force applied by the user 105, the hand crank 455*b* rotates upwards. As such, the rotation of the hand cranks 455*a*-455*b* simulates a more natural swing of the arms of the user 105. For example, in the event the user 105 chooses to operate the NASGTAS 100 via the hand cranks 455*a*-455*b*, the rotation of the hand cranks 455*a*-455*b* may simulate a more natural swing of the arms of the user 105.

Figure 5A:
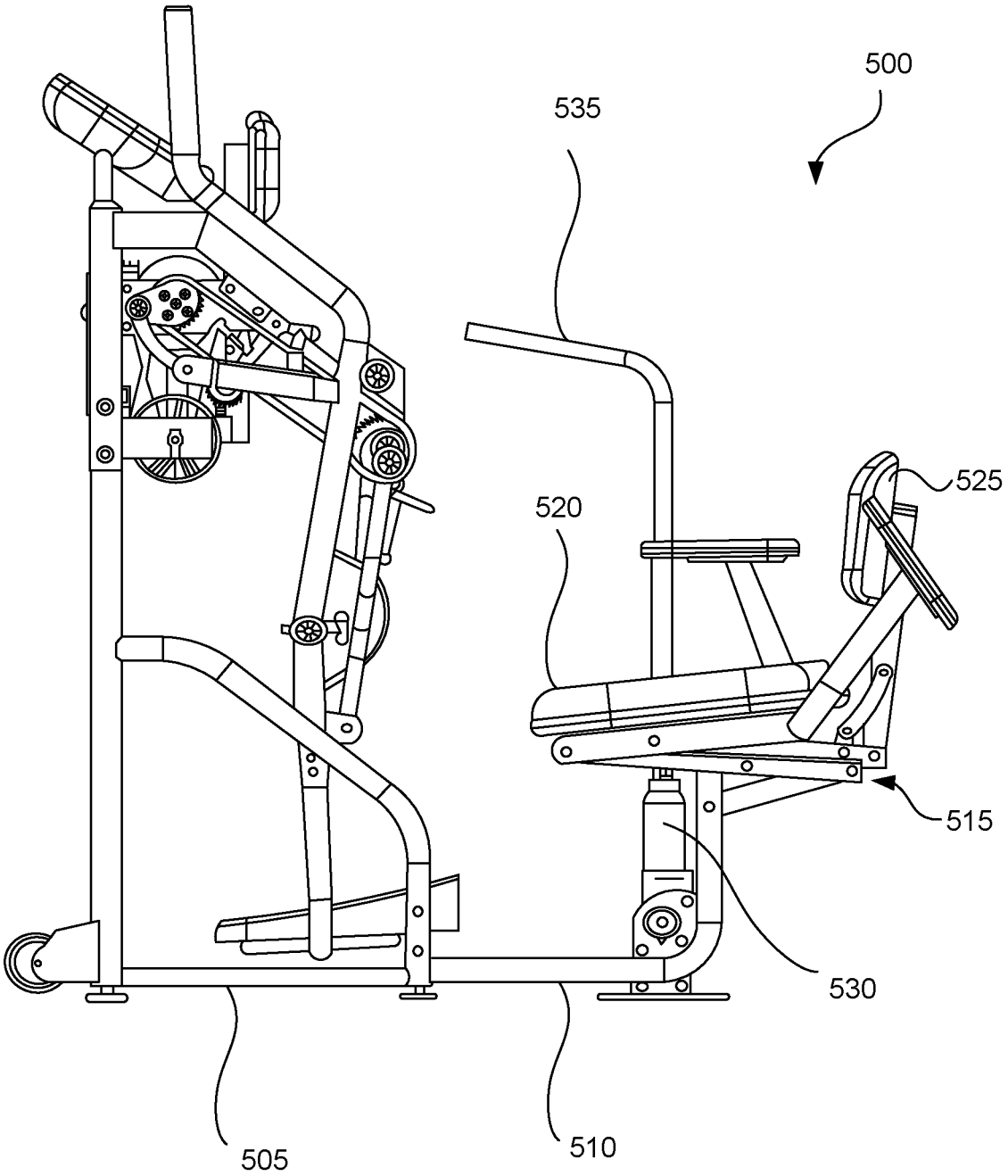
FIGS. 5A and 5B depict side views of an exemplary NASGTAS incorporating a rhombus-scissor type linkage lifting subsystem.

FIG. 5A depicts a side view of an exemplary NASGTAS incorporating a rhombus-scissor type linkage lifting subsystem. In the illustrative example of FIG. 5A, a NASGTAS 500 is shown in a seated state. The NASGTAS 500 includes a main base 505 and a seat base 510 coupled to each other to form a base of the NASGTAS 500. In various embodiments, the main base 505 and the seat base 510 may be formed of a unitary piece. The seat base 510 supports a posture positioning subsystem 515. The posture positioning subsystem 515 includes a seat 520 and a back rest 525. The posture positioning subsystem 515 includes an actuator 530 to modify an elevation of the seat 520. The actuator 530 couples to the seat base 510. A user may operate the actuator via an elevation lever 535. The elevation lever 535 may electrically connect to an electronic button such that the user 105 may operate the elevation lever 535 via the electronic button.

Figure 5B:
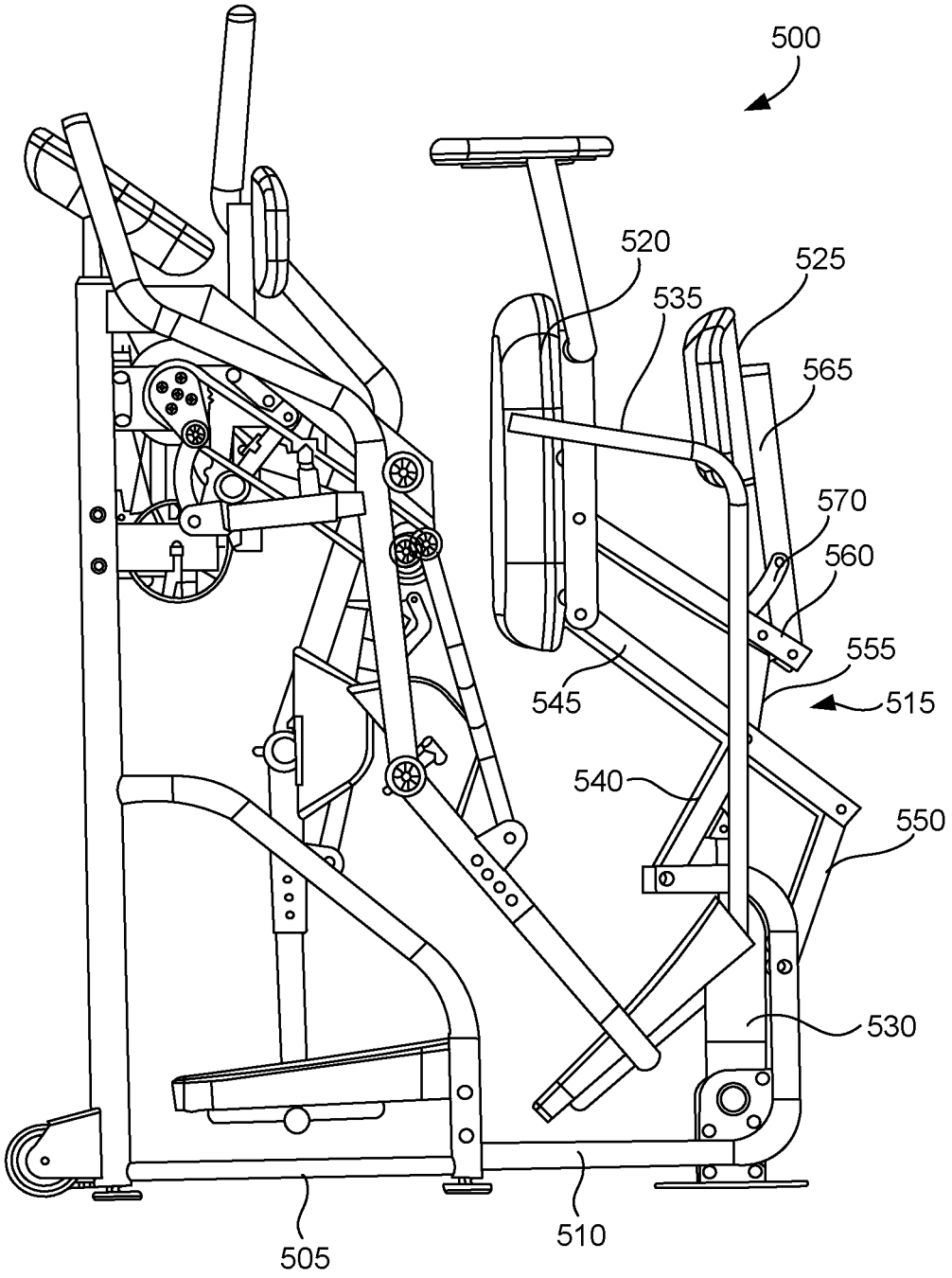

FIG. 5B depicts a side view of an exemplary NASGTAS incorporating a rhombus-scissor type linkage lifting subsystem. In the illustrative example of FIG. 5B, the NASGTAS 500 shown in a standing state. The NASGTAS 500 includes the main base 505 and the seat base 510 coupled to each other to form a base of the NASGTAS 500. In various embodiments, the main base 505 and the seat base 510 may be formed of a unitary piece. The seat base 510 supports the posture positioning subsystem 515. The posture positioning subsystem 515 includes the seat 520 and the back rest 525. The posture positioning subsystem 515 includes the actuator 530 to modify an elevation of the seat 520. The actuator 530 couples to the seat base 510. The user 105 may operate the actuator via the elevation lever 535. The elevation lever 535 may electrically connect to an electronic button such that the user 105 may operate the elevation lever 535 via the electronic button.

The posture positioning subsystem 515 includes a scissor-type linkage assembly to raise and lower the seat. A first base link 540 pivotably connects the seat base 510. The first base link 540 operably connects to the actuator 530. When activated, the actuator 530 may raise or lower the first base link 540 to raise or lower the seat 520. A first seat link 545 pivotably connects to a second base link 550. An intermediary link 555 operably connects the first seat link 545 to a second seat link 560. The intermediary link 555 operably connects to the first seat link 545 at a same connection point as the first base link 540 pivotably connects to the first seat link 545. The first seat link 545 and the second seat link 560 each pivotably connect to the seat 520.

As depicted, the operable connections of the links 540-560 form a scissor-type linkage. The scissor-type linkage, in response to the actuator 530, may raise or lower the seat in accordance with an operating force on the elevation lever 535 by the user 105. The elevation lever 535 may be a ratchet-type system, for example, to operate the actuator 530. In some embodiments, the actuator 530 may be operated via an electronic switch, for example.

The second seat link 560 pivotably connects to the back rest 525 via a back rest support member 565. A support link 570 movably connects between the back rest support member 565 and the second seat link 560. The support link 570 may support the back rest 525 such that the back rest retains sustainably the same orientation in a lowered or raised position. As depicted, the links 540-560 attach and support a side of the seat 520. A second set of links (not shown) in substantially similar arrangement may support an opposite side of the seat 520. The actuator 530 may operably connect to either a right first base link or a left first base link, or a bar connected between the right and left first base links.

In some embodiments, the posture positioning subsystem 515 may advantageously minimize a shear experienced by the user 105 when transitioning between sitting and standing modes. For example, the posture positioning subsystem 515 may secure a backside of the user 105 during transition from a sitting position to a standing position. As such, the backside of the user 105 will remain substantially in the same location relative to the seat 520 in the sitting position, the standing position, or during a walking cycle.

Figure 5C:
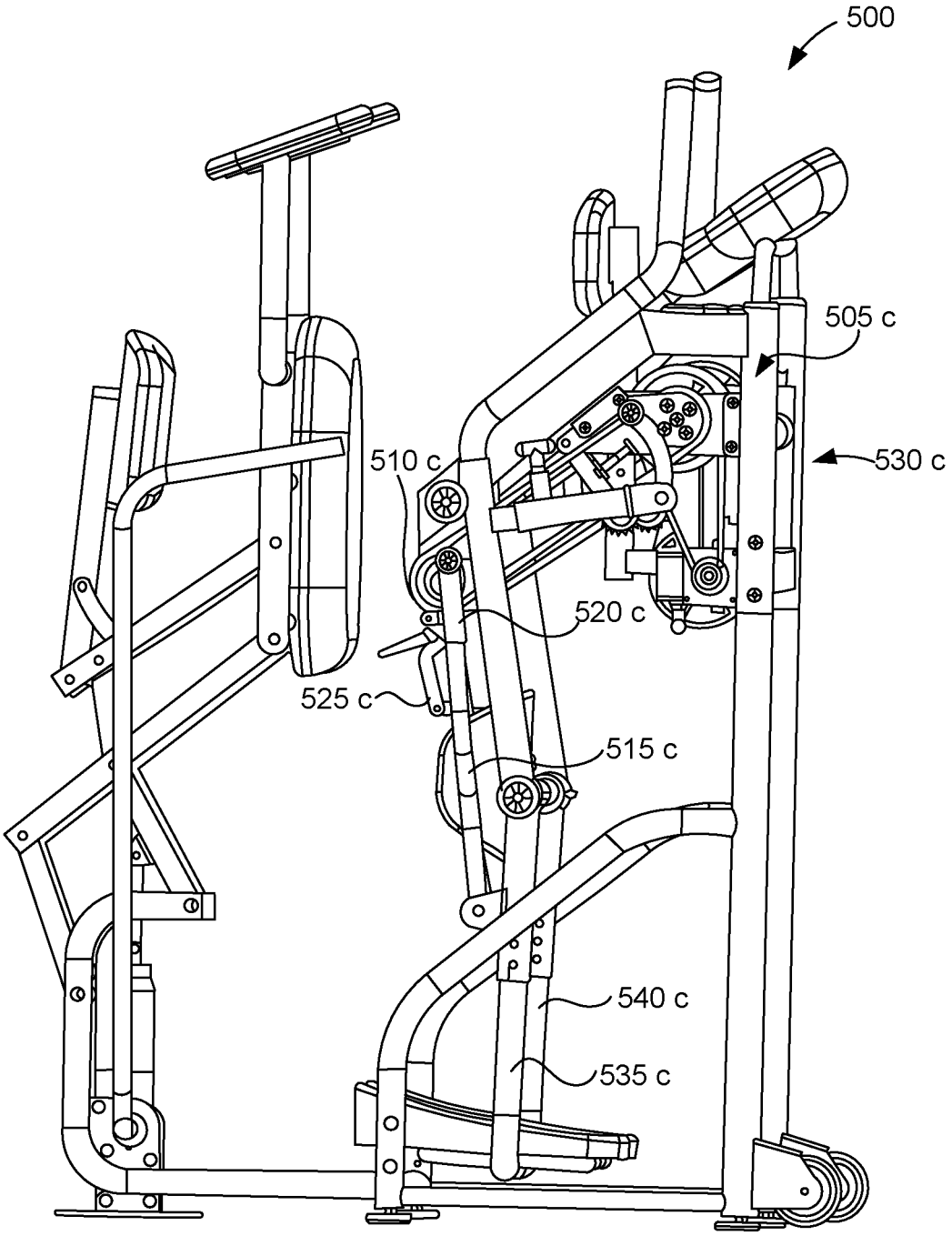
FIG. 5C depicts a side perspective view of an exemplary mode adjustment subsystem having a lever.

FIG. 5C depicts a side perspective view of an exemplary mode adjustment subsystem having a lever. A NASGTAS 500 includes a mode adjustment subsystem 505*c*. The mode adjustment subsystem 505*c* operably connects to a lower sprocket 510*c* at a distal end. The mode adjustment subsystem 505*c* includes a mode adjustment telescoping member 515*c* that extends from a mode adjustment base member 520*c*. An adjustment lever 525*c* operably connects to the mode adjustment telescoping member 515*c* and the mode adjustment base member 520*c*. When a user operates the adjustment lever 525*c*, the user may move the adjustment lever 525*c* to a locked position. When in the locked position, the adjustment lever 525*c* may effectuate a GSE 530*c* and lower leg members 535*c*, 540*c* to simulate a sit-to-stand motion.

In various embodiments, the mode adjustment subsystem 505*c* may be included in a sit-to-stand transmission system. Such sit-to-stand transmission systems are described, for example in FIG. 2, of U.S. patent application Ser. No. 14/529,568, titled "Multi-Modal Gait-Based Non-Invasive Therapy Platform," filed by Alan Tholkes on Oct. 31, 2014, the entire disclosure of which is hereby incorporated by reference.

Figure 6A:
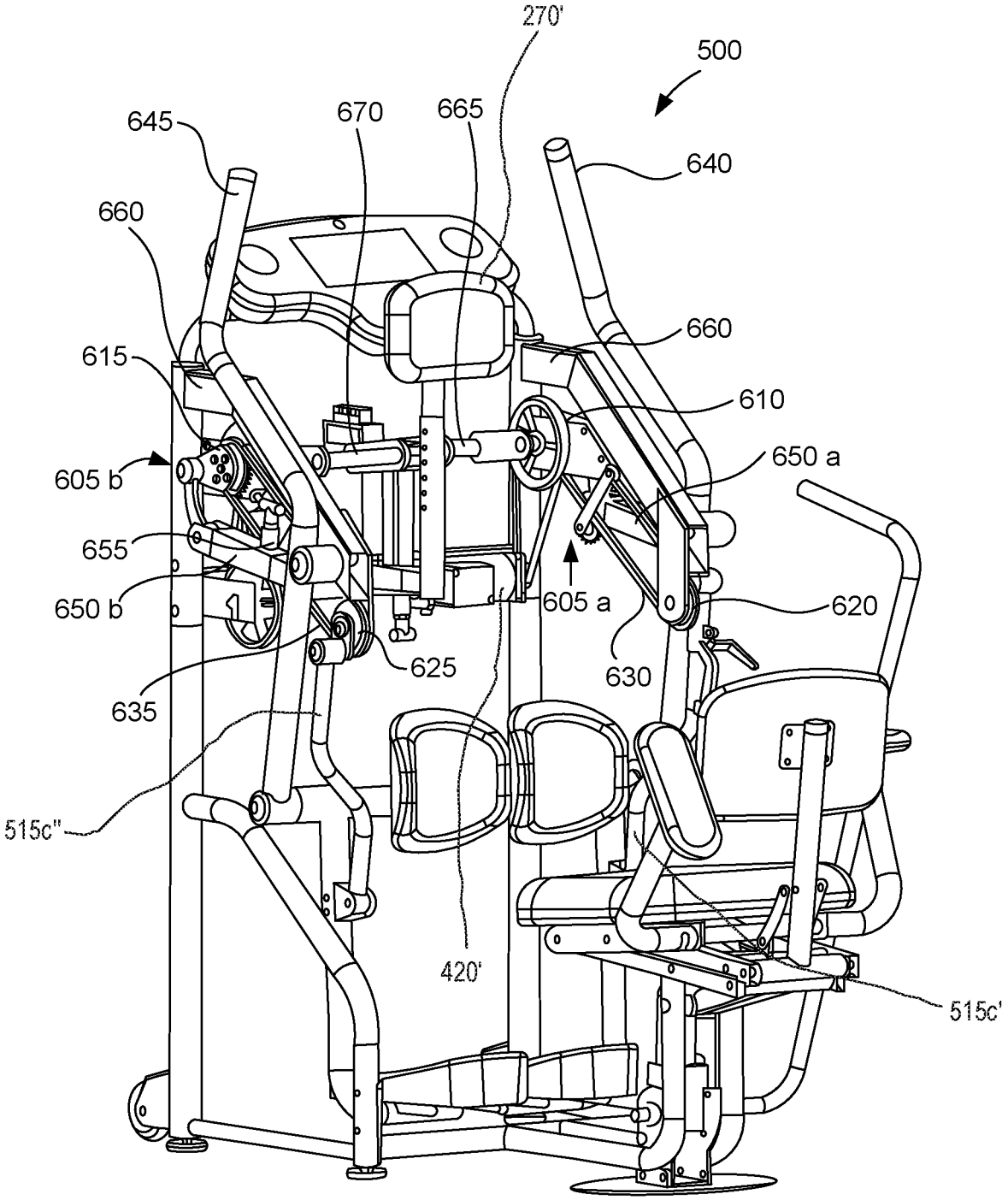
FIGS. 6A and 6B depict perspective views of an exemplary NASGTAS having crank hands at the front.

FIG. 6A depicts a back perspective view of an exemplary NASGTAS having crank hands at the front. The NASGTAS 500 includes a chain drive subsystem 605*a* and a chain drive subsystem 605*b*. The chain drive subsystems 605*a*-605*b* each include a hand crank sprocket 610, 615. The hand crank sprockets 610, 615 operably connect to lower sprockets 620, 625 via chains 630, 635, respectively. The hand crank sprockets 610, 615 operably connect to the swing arms 640, 645. As depicted, the swing arm 640 operably connects to the hand crank sprocket 610 via an adjustable connecting member 650*a*. The swing arm 645 operably connects to the hand crank sprocket 615 via an adjustable connecting member 650*b*. In various embodiments, the adjustable connecting member may include a telescoping member that may adjust a leg stride for a user. A securing pin 655 may lock the telescoping member.

A right hand crank 665 and a left hand crank 670 operably connect to the chain drive subsystems 605*a*-605*b* via the hand crank sprockets 610, 615, respectively. The right hand crank 665 and the left hand crank 670 are disposed within an interior of an upper frame 660 and arranged so that a user may operate the chain drive subsystems 605*a*-605*b* by rotating the hand cranks 665-670 via extensions of a user's arms. When rotated, the hand cranks 665-670 operate the chain drive subsystems 605*a*-605*b* via the hand crank sprockets 610, 615. The chain drive subsystems 605*a*-605*b* drive the NASGATS 500 to simulate a natural walking motion for a user.

Figure 6B:
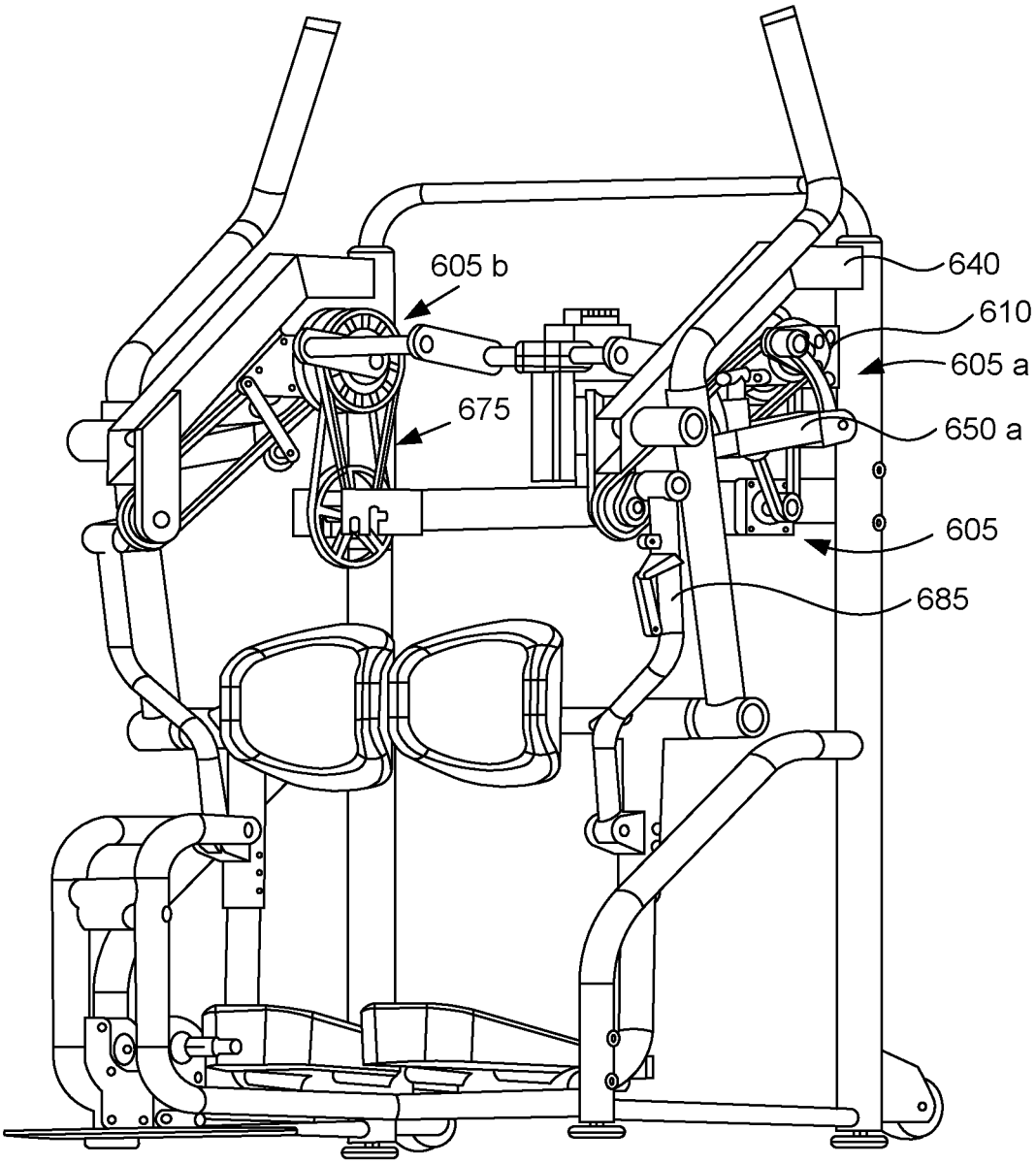

FIG. 6B depicts a rear perspective view of an exemplary NASGTAS having crank hands at the front. The chain drive subsystems 605*a*-605*b* are disposed within an interior of the upper frame 660 of the NASGTAS 500. The chain drive subsystems 605*a*-605*b* operably connect to each other via a flywheel subsystem 675 arranged to maintain an uninterrupted walking motion.

Figure 7:
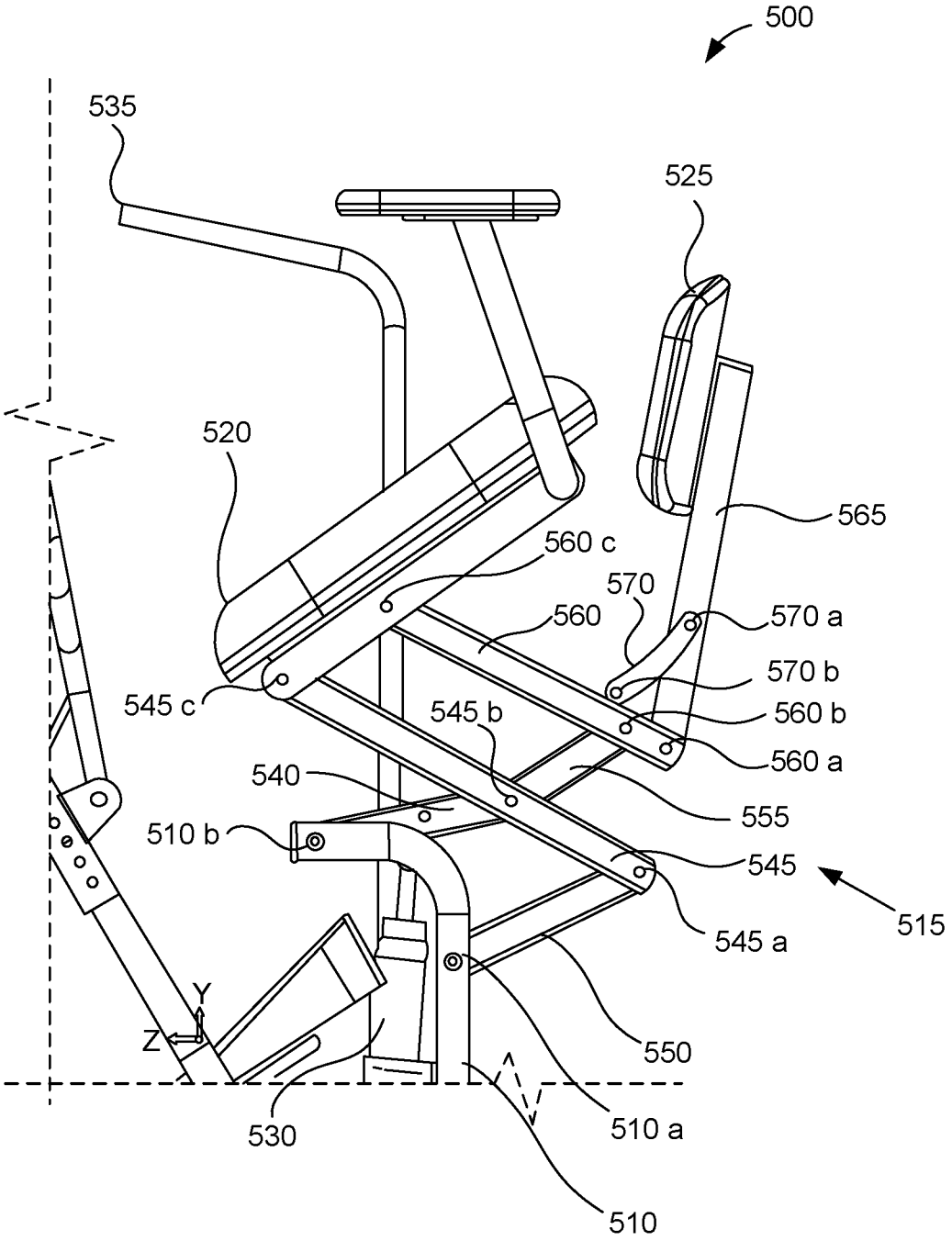
FIG. 7 depicts a side view of an exemplary rhombus-scissor type linkage lifting subsystem.

FIG. 7 depicts a side view of an exemplary rhombus-scissor type linkage lifting subsystem. In the illustrative example of FIG. 7, the NASGTAS 500 shown in an intermediate state (e.g., between seated and standing states).

As an illustrative example, the lengths between coupling points between the links 540-560 are as follows. The distance between coupling points 510*a* and 510*b* may be about 8 inches. The distance between coupling points 510*a* and 545*a* may be about 9.25 inches. The distance between coupling points 510*b* and 545*b* may be about 9 inches. The distance between coupling points 545*a* and 545*b* may be about 6.5 inches. The distance between coupling points 545*a* and 545*c* may be about 18 inches. The distance between coupling points 545*b* and 560*b* may be about 6 inches. The distance between coupling points 560*a* and 560*c* may be about 14 inches. The distance between coupling points 560*b* and 560*c* may be about 12 inches. The distance between coupling points 560*c* and 545*c* may be about 5.5 inches. The distance between coupling points 570*a* and 560*a* may be about 5.38 inches. The distance between coupling points 570*a* and 570*b* may be about 4.38 inches. The inner angle between the first base link 540 and the intermediary link 555 may be about 160 degrees.

The exact dimensions of the posture positioning subsystem 515 may be different than as stated above. For example, a NASGTAS tailored for a taller or shorter person may have longer or shorter dimensions. In some embodiments, the dimensions of the links in the posture positioning subsystem 515 may be greater or less than the numbers in the above illustrative embodiment by about 1, 2, 3, 4, 5, 6, 7, 8, 9, 10, 11, 12, 13, 14, 15, 16, 17, or about 18 inches.

Figure 8A:
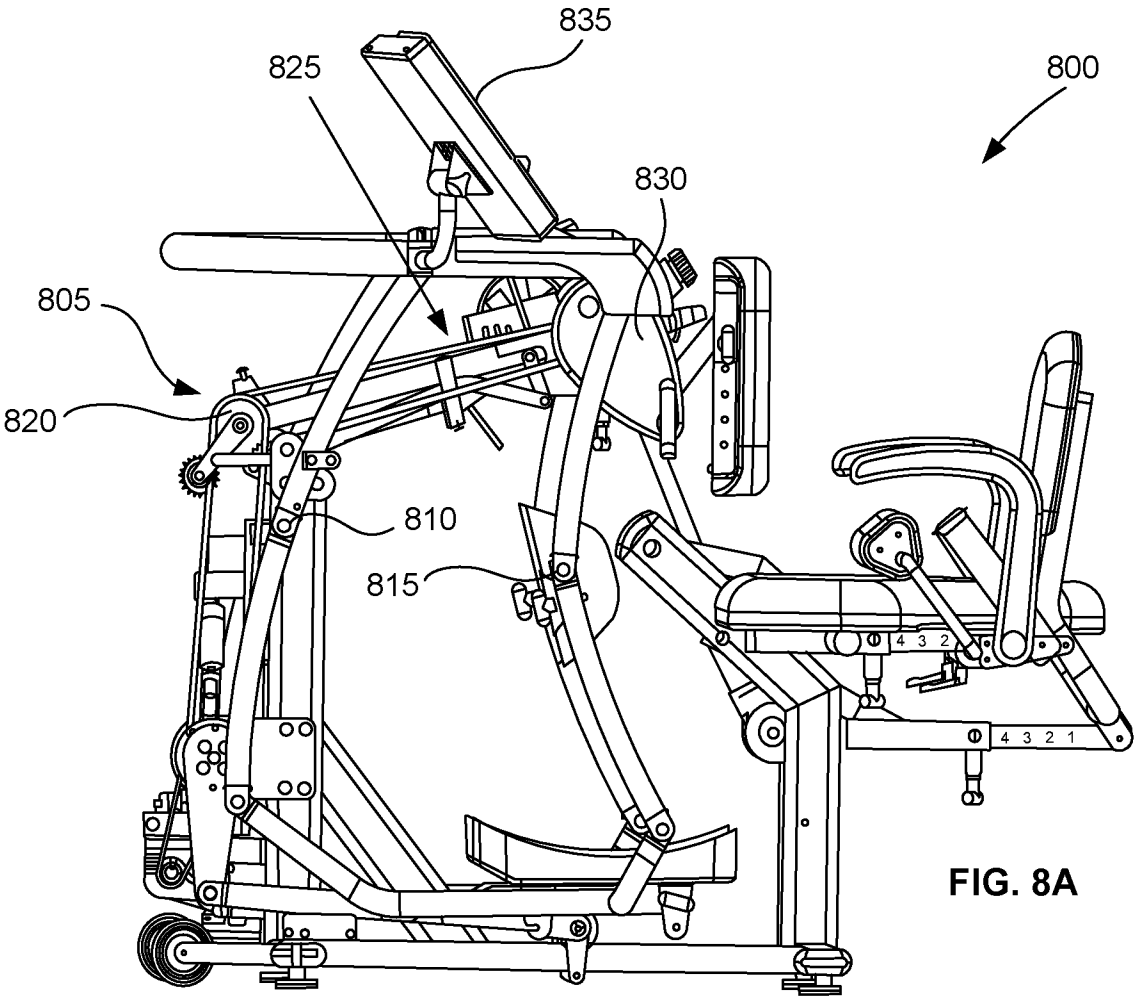
FIG. 8A depicts a side perspective view of an exemplary NASGTAS having an adjustable gait mode subsystem.
Figure 8B:
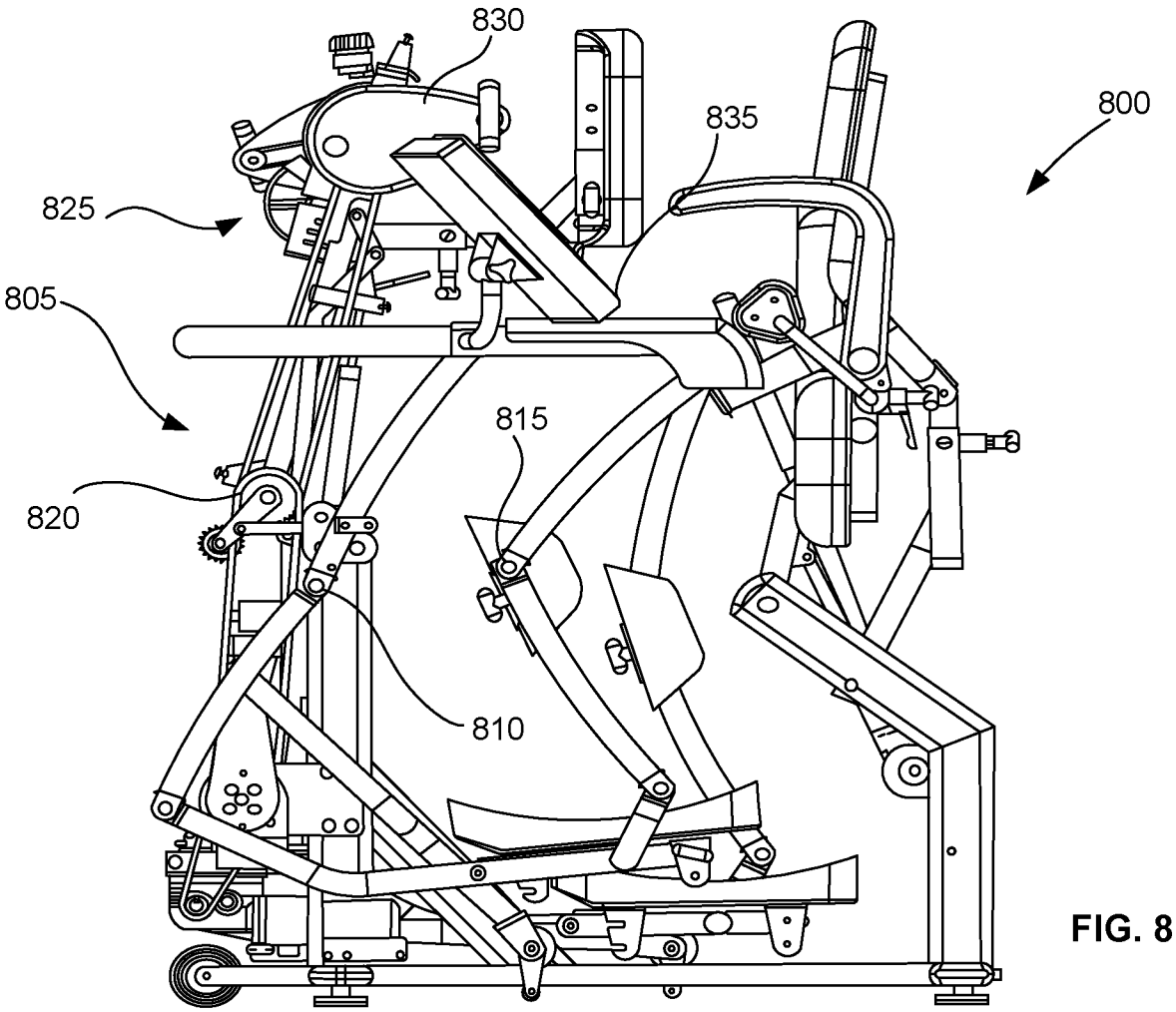
FIG. 8B depicts a side view of an exemplary NASGTAS having an adjustable gait mode subsystem.
Figure 9:
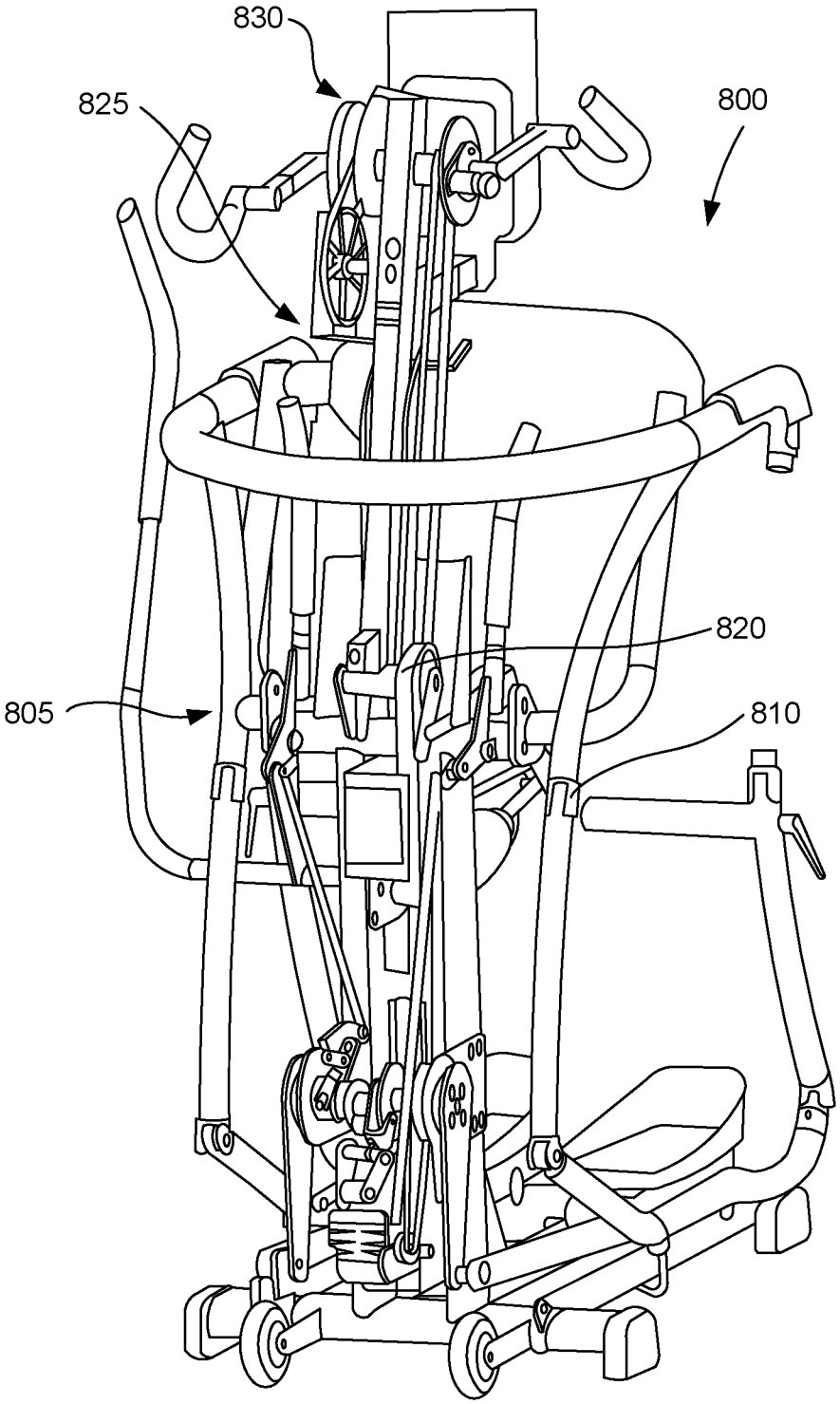
FIG. 9 depicts a perspective view of an exemplary NASGTAS having an adjustable gait mode subsystem.

FIGS. 8A, 8B, and 9 depict a side perspective view, a side view, and a front perspective view of an exemplary NASGTAS having an adjustable gait mode subsystem, respectively. A NASGTAS 800 includes a mode transmission system 805 that permits a user to simulate a gait independent of whether the user may be in a sitting position (FIG. 8A) or in a standing position (FIG. 8B). The NASGTAS 800 includes pivot points 810, 815, and 820. The upper portion 825 includes a hand crank subsystem 830 and an operations console 835. As such, the user may access the hand crank subsystem 830 and the operation console 835 from either a sitting position or a standing position. The NASGTAS 800 may advantageously provide the user with different exercises. For example, a user may use the NASGTAS 800 to move the user's lower legs when sitting down.

Figure 10:
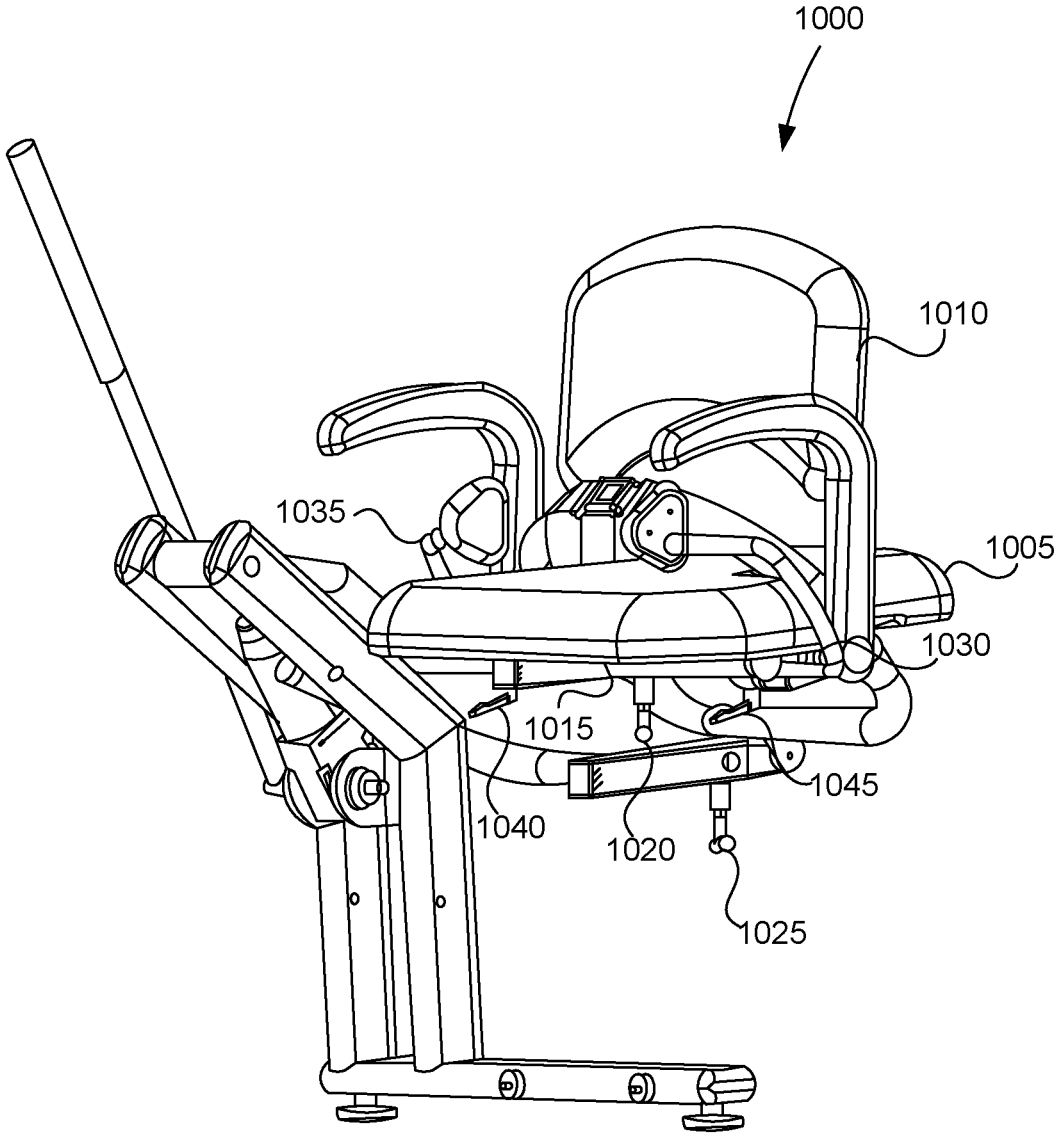
FIG. 10 depicts a front perspective view of an exemplary lift subsystem.

FIG. 10 depicts a front perspective view of an exemplary lift subsystem. A lift subsystem 1000 includes a seat 1005 and a back rest 1010. The seat 1005 and the back rest 1010 operably connect to adjustable support brackets 1015. The adjustable support brackets include locking pins 1020, 1025 to secure the support brackets 1015. As depicted, the locking pins 1020, 1025 are spring biased such that a user need only pull the locking pins 1020, 1025 to release the support brackets 1015 to adjust the seat 1005 and the back rest 1010.

The lift subsystem 1000 includes hip supports 1030, 1035. The hip supports 1030, 1035 may be adjusted to accommodate different sized users. Hip levers 1040, 1045 may allow a user to adjust the hip supports. In various embodiments, a user may adjust the hip supports 1030, 1035 as needed to provide support to the user's hips. The hip supports 1030, 1035 may releasably attach to the support brackets 1015 such that a user may advantageously remove the hip supports 1030, 1035 when not needed.

Figure 11A:
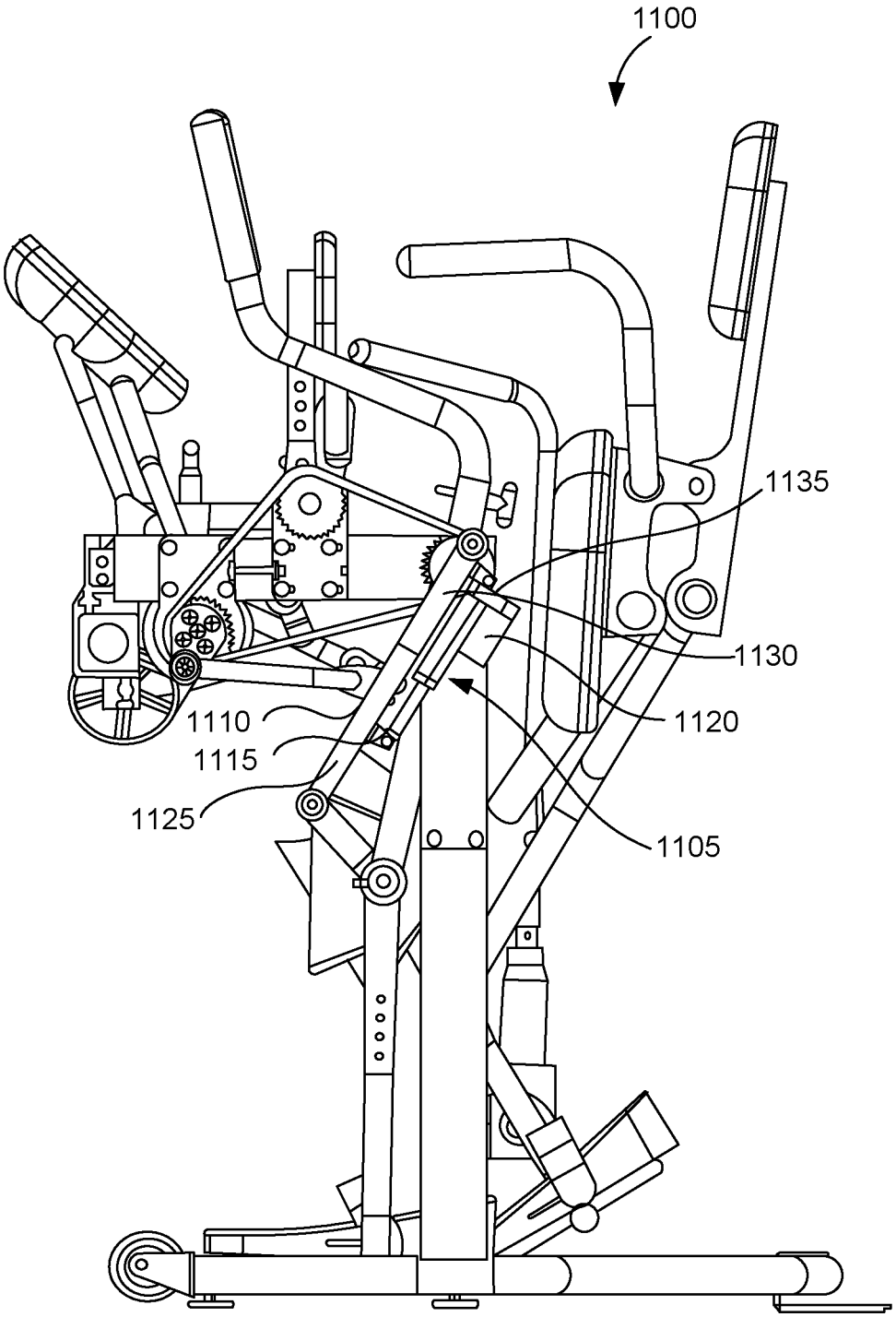
FIG. 11A depicts a side view of an exemplary mode adjustment subsystem in an unlocked position.

FIG. 11A depicts a side view of an exemplary mode adjustment subsystem in an unlocked position. A NASGTAS 1100 includes a mode adjustment subsystem 1105. The mode adjustment subsystem 1105 operably mounts along a side of an upper leg member 1110. A mode adjustment telescoping member 1115 extends from a mode adjustment base member 1120 to define a path of the mode adjustment subsystem 1105. An upper leg telescoping member 1125 extends from an upper leg base member 1130. The mode adjustment base member 1120 couples to the upper leg base member 1130 at an upper end 1135. The mode adjustment telescoping member 1115 operably couples to the upper leg telescoping member 1125 such that when the mode adjustment telescoping member 1115 extends, or retracts, the upper leg telescoping member 1125 responds accordingly. As depicted, the mode adjustment subsystem 1105 is in an unlocked position as can be identified by the extended upper leg telescoping member 1125. The unlocked position may permit the upper leg telescoping member 1125 to extend and retract without interrupting a natural gait motion of the NASGTAS 1100.

Figure 11B:
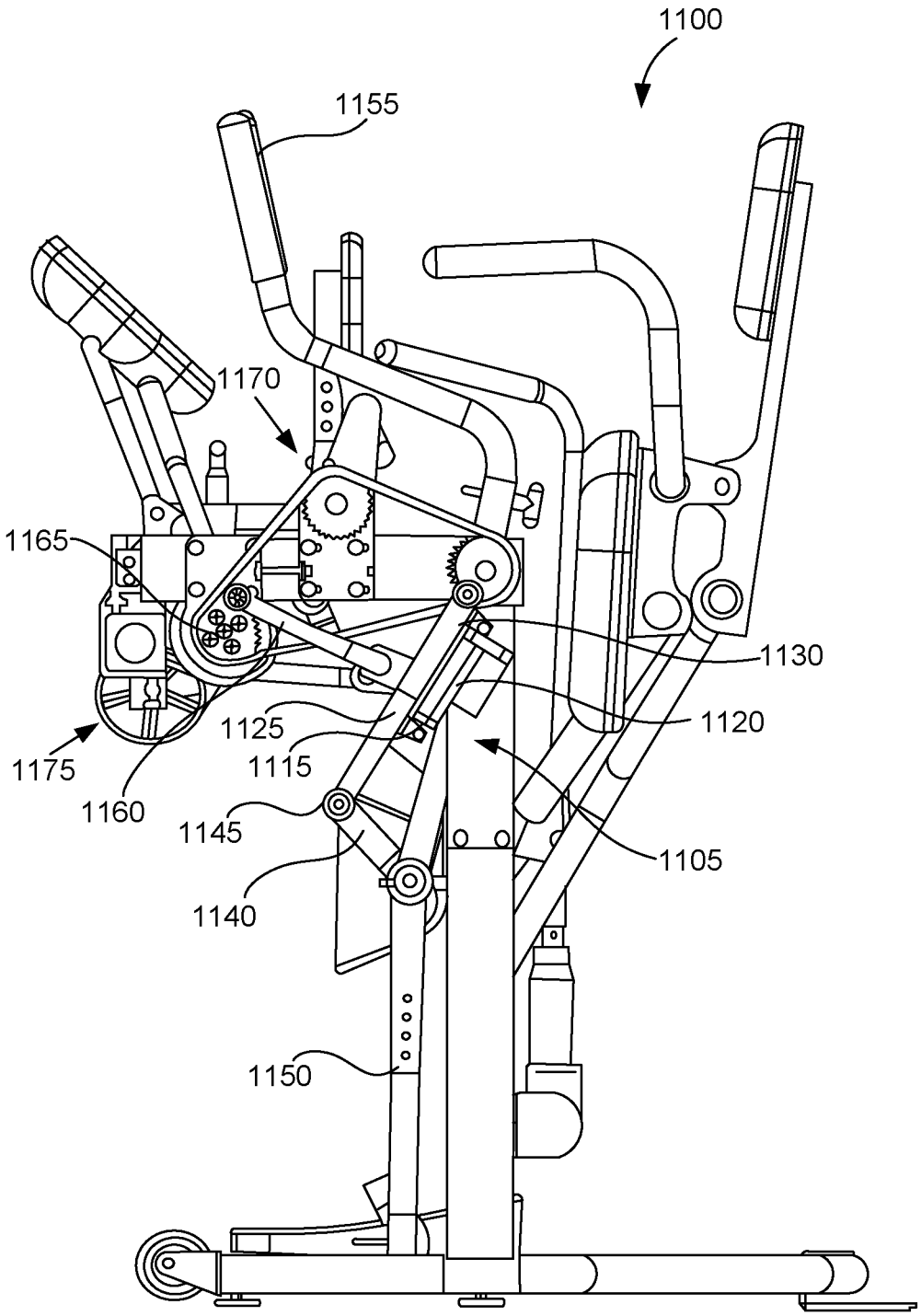
FIG. 11B depicts a side view of an exemplary mode adjustment subsystem in a locked position.

FIG. 11B depicts a side view of an exemplary mode adjustment subsystem in a locked position. As depicted, the mode adjustment subsystem 1105 is in a locked position. The mode adjustment telescoping member 1115 is inserted into the mode adjustment base member 1120 such that the mode adjustment telescoping member 1115 causes the upper leg telescoping member 1125 to retract into the upper leg base member 1130. An intermediary link 1140 pivotably connects to the upper leg telescoping member 1125 at a pivot point 1145. The intermediary link 1140 pivotably connects to a lower leg member 1150. The intermediary link 1140 pivotably connects to a swing arm 1155 at the same pivot point as to the lower leg member 1150.

When the upper leg telescoping member 1125 retracts into the upper leg base member 1130, the intermediary link 1140 straightens the lower leg member 1150 to a substantially straight position. The intermediary link 1140 also substantially straightens the swing arm 1155 such that an adjustable connecting member 1160 operably connected to a flywheel sprocket 1165 rotates the flywheel sprocket 1165 effectuating a rotation of a chain drive subsystem 1170. The rotation of the chain drive subsystem 1170 transfers, via a flywheel subassembly 1175, a rotation of a corresponding chain drive subsystem (not shown). In response to the rotation, the corresponding chain drive subsystem effectuates a corresponding leg assembly (not shown) such that the lower leg member 1150 substantially aligns with a lower leg member (not shown) of the corresponding leg assembly. As such, when the lower leg members align and lock in place, via the mode adjustment subsystem 1105. Advantageously, the NASGTAS 100 may secure the legs of the user 105 in a stationary position to simulate a sit-to-stand motion.

Although various embodiments have been described with reference to the Figures, other embodiments are possible. For example, with reference to FIGS. 1-4, the user 105 may manually operate the NASGTAS 100 via rotating hand cranks, such as the hand crank 455*a*-455*b*. The hand cranks may operably connect to a sprocket or pulley that rotates clockwise or counter-clockwise to simulate a forward walking motion or a backward walking motion. The sprocket (e.g., hand crank sprocket 350*a*-350*b*) may be interchangeable. As such, the sprocket may be of various diameters to modify a gear ratio to either increase or decrease the ease with which to move the user's 105 legs.

When rotated, via the hand cranks, the sprocket may effectuate the motion of additional sprockets via a chain (e.g., chain 360*a*). One of the additional sprockets, such as, for example, the flywheel sprockets 345*a*-345*b*, may rotate, via an offsetting link, a gait stride linkage (e.g., adjustable connecting members 348*a*-348*b*) to effectuate a forward or backward motion. The gait stride linkage may operably attach to an upper leg support. For example, with reference to FIG. 3, the arm swing lever 285*a* pivotably connects to the upper frame 405 at a frame pivot point. The upper leg support may include the support member below the frame pivot point. In various embodiments, the upper leg support member may pivot independently of the arm swing lever 285*a*. The upper leg support may pivot at the frame pivot point. The gait stride linkage may mount to the upper leg support at a mount point. The mount point may determine a degree of angle relative to a pivot point of the upper leg in relation to the frame pivot point.

In various embodiments, when the user rotates the hand cranks, the sprocket (e.g., hand crank sprocket 350*a*-350*b*) may also rotate. The sprocket may operably connect to a lower leg positioning linkage (e.g., drive members 330*a*-330*b*). The lower positioning linkage may operably connect to the intermediary link 1140, with reference to FIG. 11B, which pivots at the intermediary pivot point. The intermediary pivot point may also be the pivot point for the knee support 325*a*, for example. As the sprocket rotates, the lower leg position linkage may rotate the lower leg supports to simulate proper positioning of the user's 105 legs during a walk cycle. The lower leg positioning linkage may adjust, via an actuator, for example, the length of the lower leg position linkage to accommodate a parallel left and right leg position for standing. For example, the actuator in an extended position may position the legs for walking. In some embodiments, an over-center lever may be used to adjust the lower leg positioning linkage.

The flywheel sprocket may operably connect to a connecting shaft which connects a right gait mechanism to a left gait mechanism (e.g., chain drive subsystems) in the opposite linkage patterns, to facilitate a user's natural walking motion. A weighted flywheel mounts on a connecting shaft (e.g., flywheel shaft 368). When the user 105 manually activates a walking cycle, the weighted flywheel may maintain a smooth walking motion with a centrifugal force generated from the multiple geared pulley system. The connecting shaft may rotate either manually by the user 105 using the hand cranks, or via the motor 420, for example, connected to the connecting shaft. The motor 420 may operably connect to a motor controller such as the smart control module 460, for example. The motor controller may detect an amount of amperage needed to maintain predetermined revolutions per minute (RPM). The predetermined RPM may be determined by the user or a third party, such as an attending physician, for example. The motor 420 may augment and assist the user when walking with in the NASGTAS 100. For example, in the event the user does not maintain a predetermined RPM, the motor 420, via the motor controller, may detect a resistance. In response to the resistance, the motor controller may increase an amperage to the motor 420 to assist the user 105 during operation of the NASGTAS 100. If the user does maintain a predetermined RPM, the motor controller may determine that less amperage needed. The motor controller may provide real time "percentage assistance" provided by the motor. Accordingly, the motor may assist the user 105 during a walking cycle.

In some embodiments, the swing arm levers may operably connect to the upper leg members to move the upper leg members forward and backward. The spring arm levers may assist the user 105 during the walking cycle. The rotating hand cranks may also assist the user 105 during a walking cycle. The motor 420 may also assist the user 105 during a walking cycle.

In various embodiments, a base (e.g., V-shaped base 205) may be arranged such that the user 105 may transfer from a wheelchair, for example, to the NASGTAS 100 without any obstructions. For example, the base below the seat may be arranged such that the base substantially resides below the seat to permit the user 105 to position themselves next to the seat when transferring. The arm rests 235*a*-235*b* may also connect to the NASGTAS 100 such that the arm rests 235*a*-235*b* may be moved out of the way during the transfer from the wheelchair to the NASGTAS 100.

In some embodiments, the GSE 280 may control important aspects of a gait cycle such as when a user heel strike occurs, for example. The GSE 280 may control an occurrence of a user's toe-off as well as a lift of a leg and foot angles. The GSE 280 may also control the velocity of a walking motion as well as a length of the gait (e.g., stride). A user may rotate a sprocket, such as the drive sprockets 335*a*-335*b*, for example, to a degree needed to perform a desired leg and foot movement.

The NASGTAS 100 may include transportation wheels. The transportation wheels may facilitate a moving of the NASGTAS 100. For example, moving personnel may tilt the NASGTAS 100 such that the transportation wheels contact a floor. In the tilted position, the moving personnel may more easily move the NASGTAS 100 to a new location. Advantageously, the transportation wheels may allow a single person to move the NASGTAS 100. The NASGTAS 100 may further include leveling guides. The leveling guides may be screw-type leveling guides, for example, to provide further stability when the NASGTAS 100 is located on an uneven surface.

The arm rests 285*a*-285*b* may include flip upside supports. The flip upside supports may permit the arm rests to be moved so that a user may transition onto the NASGTAS 100 more easily.

Some aspects of embodiments may be implemented as a computer system. For example, various implementations may include digital and/or analog circuitry, computer hardware, firmware, software, or combinations thereof. Apparatus elements can be implemented in a computer program product tangibly embodied in an information carrier, e.g., in a machine-readable storage device, for execution by a programmable processor; and methods can be performed by a programmable processor executing a program of instructions to perform functions of various embodiments by operating on input data and generating an output. Some embodiments can be implemented advantageously in one or more computer programs that are executable on a programmable system including at least one programmable processor coupled to receive data and instructions from, and to transmit data and instructions to, a data storage system, at least one input device, and/or at least one output device. A computer program is a set of instructions that can be used, directly or indirectly, in a computer to perform a certain activity or bring about a certain result. A computer program can be written in any form of programming language, including compiled or interpreted languages, and it can be deployed in any form, including as a stand-alone program or as a module, component, subroutine, or other unit suitable for use in a computing environment.

Suitable processors for the execution of a program of instructions include, by way of example and not limitation, both general and special purpose microprocessors, which may include a single processor or one of multiple processors of any kind of computer. Generally, a processor will receive instructions and data from a read-only memory or a random access memory or both. The essential elements of a computer are a processor for executing instructions and one or more memories for storing instructions and data. Storage devices suitable for tangibly embodying computer program instructions and data include all forms of non-volatile memory, including, by way of example, semiconductor memory devices, such as EPROM, EEPROM, and flash memory devices; magnetic disks, such as internal hard disks and removable disks; magneto-optical disks; and, CD-ROM and DVD-ROM disks. The processor and the memory can be supplemented by, or incorporated in, ASICs (application-specific integrated circuits). In some embodiments, the processor and the member can be supplemented by, or incorporated in hardware programmable devices, such as FPGAs, for example.

In some implementations, each system may be programmed with the same or similar information and/or initialized with substantially identical information stored in volatile and/or non-volatile memory. For example, one data interface may be configured to perform auto configuration, auto download, and/or auto update functions when coupled to an appropriate host device, such as a desktop computer or a server.

In some implementations, one or more user-interface features may be custom configured to perform specific functions. An exemplary embodiment may be implemented in a computer system that includes a graphical user interface and/or an Internet browser. To provide for interaction with a user, some implementations may be implemented on a computer having a display device, such as an LCD (liquid crystal display) monitor for displaying information to the user, a keyboard, and a pointing device, such as a mouse or a trackball by which the user can provide input to the computer.

In various implementations, the system may communicate using suitable communication methods, equipment, and techniques. For example, the system may communicate with compatible devices (e.g., devices capable of transferring data to and/or from the system) using point-to-point communication in which a message is transported directly from the source to the first receiver over a dedicated physical link (e.g., fiber optic link, point-to-point wiring, daisy-chain). The components of the system may exchange information by any form or medium of analog or digital data communication, including packet-based messages on a communication network. Examples of communication networks include, e.g., a LAN (local area network), a WAN (wide area network), MAN (metropolitan area network), wireless and/or optical networks, and the computers and networks forming the Internet. Other implementations may transport messages by broadcasting to all or substantially all devices that are coupled together by a communication network, for example, by using Omni-directional radio frequency (RF) signals. Still other implementations may transport messages characterized by high directivity, such as RF signals transmitted using directional (i.e., narrow beam) antennas or infrared signals that may optionally be used with focusing optics. Still other implementations are possible using appropriate interfaces and protocols such as, by way of example and not intended to be limiting, USB 2.0, Fire wire, ATA/IDE, RS-232, RS-422, RS-485, 802.11 a/b/g, Wi-Fi, WiFi-Direct, Li-Fi, BlueTooth, Ethernet, IrDA, FDDI (fiber distributed data interface), token-ring networks, or multiplexing techniques based on frequency, time, or code division. Some implementations may optionally incorporate features such as error checking and correction (ECC) for data integrity, or security measures, such as encryption (e.g., WEP) and password protection.

A number of implementations have been described. Nevertheless, it will be understood that various modification may be made. For example, advantageous results may be achieved if the steps of the disclosed techniques were performed in a different sequence, or if components of the disclosed systems were combined in a different manner, or if the components were supplemented with other components. Accordingly, other implementations are within the scope of the following claims.

What is claimed is:

1. A natural assist simulated gait therapy adjustment system (500) comprising:

a seat base (510);

a seat (520) supported by the seat base (510) via a posture positioning system (515) configured to transition between a seated state with a top surface of the seat (520) angled substantially parallel to horizontal, and a standing state with the top surface of the seat (520) angled substantially parallel to vertical; and, a gait simulating engine (530*c*) configured to simulate a natural gait of a user, the gait simulating engine (530*c*) comprising:

a first drive sprocket (610) that drives swinging motion of a first swing arm (640) in response to rotation of the first drive sprocket (610);

a first driven sprocket (620) coupled to the first drive sprocket (610) via a first chain (630), the first driven sprocket (620) driving gait motion of a first lower leg member (535*c*) in response to rotation of the first driven sprocket (620);

a second drive sprocket (615) that drives swinging motion of a second swing arm (645) in response to rotation of the second drive sprocket (615);

a second driven sprocket (625) coupled to the second drive sprocket (615) via a second chain (635), the second driven sprocket (625) driving gait motion of a second lower leg member (540*c*) in response to rotation of the second driven sprocket (625); and, a coupling member (665, 670) operably coupled to and disposed between the first and second drive sprockets (610, 615), such that when the first and second drive sprockets (610, 615) rotate, the first and second drive sprockets (610, 615) rotate together, wherein during a transition from the seated state to the standing state, the seat (520) articulates upward and forward while increasing an angle of the top surface of the seat (520) with respect to horizontal from substantially 0 degrees in the seated state to substantially 90 degrees in the standing state.

2. The natural assist simulated gait therapy adjustment system (500) claim 1, wherein the posture positioning system (515) is a scissor linkage system comprising:

a first base link (540) pivotably coupled to the seat base (510);

a second base link (550) pivotably coupled to the seat base (510);

a first seat link (545) pivotably coupled to the first base link (540), the second base link (550), and a bottom of the seat (520);

a second seat link (560) pivotably coupled to the bottom of the seat (520); and, an intermediary link (555) that operably couples the first seat link (545) to the second seat link (560).

3. The natural assist simulated gait therapy adjustment system (500) of claim 2, further comprising an actuator (530) coupled at a proximal end to the seat base (510), and coupled at a distal end to the first base link (540), such that articulation of the actuator (530) modifies an elevation of the seat (520).

4. The natural assist simulated gait therapy adjustment system (500) of claim 2, further comprising a back rest (525)

coupled to a back rest support member (565), wherein the second seat link (560) pivotably couples to the back rest support member (565).

5. The natural assist simulated gait therapy adjustment system (500) of claim 4, further comprising a support link (570) movably coupled between the back rest support member (565) and the second seat link (560), wherein the support link (570) supports the back rest (525) such that the back rest (525) remains in the same orientation in a lowered or raised position.

6. The natural assist simulated gait therapy adjustment system (500) of claim 1, wherein the coupling member (665, 670) comprises a right hand crank (665) and a left hand crank (670) operable to rotate the first and second drive sprockets (610, 615) in response to rotation of the right and left hand cranks (665, 670).

7. The natural assist simulated gait therapy adjustment system (500) of claim 1, further comprising a motor (420') that selectively drives rotation of the coupling member (665, 670) to impart rotation on the first and second drive sprockets (610, 615).

8. The natural assist simulated gait therapy adjustment system (500) of claim 1, further comprising:

a main base (505) coupled to the seat base (510);

an upper frame (660) coupled to the main base (505), the upper frame (660) retaining the gait simulating engine (530*c*).

9. The natural assist simulated gait therapy adjustment system (500) of claim 8, further comprising a chest pad (270') releasably coupled to the upper frame (660), such that in the standing state, the chest pad (270') prevents a standing user from falling forward.

10. The natural assist simulated gait therapy adjustment system (500) of claim 8, further comprising:

a first adjustable connecting member (650*a*) coupling the first swing arm (640) to the first drive sprocket (610);

a first mode adjustment telescoping member (515*c*') coupling the first lower leg member (535*c*) to the first driven sprocket (620);

a first knee support (325*b*) coupled to a distal end of the first lower leg member (535*c*);

a first foot rest (305*b*) coupled to a proximal end of the first lower leg member (535*c*);

a second adjustable connecting member (650*b*) coupling the second swing arm (645) to the second drive sprocket (615);

a second mode adjustment telescoping member (515*c*") coupling the second lower leg member (540*c*) to the second driven sprocket (625);

a second knee support (325*a*) coupled to a distal end of the second lower leg member (540*c*); and, a second foot rest (305*a*) coupled to a proximal end of the second lower leg member (540*c*), wherein the first lower leg member (535*c*) is pivotably coupled at a distal end to a proximal end of the first swing arm (640), and the second lower leg member (540*c*) is pivotably coupled at a distal end to a proximal end of the second swing arm (645).

11. A natural assist simulated gait therapy adjustment system (500) comprising:

a seat base (510); and, a seat (520) supported by the seat base (510) via a posture positioning system (515) configured to transition between a seated state with a top surface of the seat (520) angled substantially parallel to horizontal, and a standing state with the top surface of the seat (520) angled substantially parallel to vertical, wherein:

during a transition from the seated state to the standing state, the seat (520) articulates upward and forward while increasing an angle of the top surface of the seat (520) with respect to horizontal from substantially 0 degrees in the seated state to substantially 90 degrees in the standing state, and the posture positioning system (515) is a scissor linkage system comprising:

a first base link (540) pivotably coupled to the seat base (510);

a second base link (550) pivotably coupled to the seat base (510);

a first seat link (545) pivotably coupled to the first base link (540), the second base link (550), and a bottom of the seat (520);

a second seat link (560) pivotably coupled to the bottom of the seat (520); and, an intermediary link (555) that operably couples the first seat link (545) to the second seat link (560).

12. The natural assist simulated gait therapy adjustment system (500) of claim 11, further comprising an actuator (530) coupled at a proximal end to the seat base (510), and coupled at a distal end to the first base link (540), such that articulation of the actuator (530) modifies an elevation of the seat (520).

13. The natural assist simulated gait therapy adjustment system (500) of claim 11, further comprising a back rest (525) coupled to a back rest support member (565), wherein the second seat link (560) pivotably couples to the back rest support member (565).

14. The natural assist simulated gait therapy adjustment system (500) of claim 13, further comprising a support link (570) movably coupled between the back rest support member (565) and the second seat link (560), wherein the support link (570) supports the back rest (525) such that the back rest (525) remains in the same orientation in a lowered or raised position.

15. The natural assist simulated gait therapy adjustment system (500) of claim 11, further comprising:

a gait simulating engine (530*c*) configured to simulate a natural gait of a user, the gait simulating engine (530*c*) comprising:

a first drive sprocket (610) that drives swinging motion of a first swing arm (640) in response to rotation of the first drive sprocket (610);

a first driven sprocket (620) coupled to the first drive sprocket (610) via a first chain (630), the first driven sprocket (620) driving gait motion of a first lower leg member (535*c*) in response to rotation of the first driven sprocket (620);

a second drive sprocket (615) that drives swinging motion of a second swing arm (645) in response to rotation of the second drive sprocket (615);

a second driven sprocket (625) coupled to the second drive sprocket (615) via a second chain (635), the second driven sprocket (625) driving gait motion of a second lower leg member (540*c*) in response to rotation of the second driven sprocket (625); and, a coupling member (665, 670) operably coupled to and disposed between the first and second drive sprockets (610, 615), such that when the first and second drive sprockets (610, 615) rotate, the first and second drive sprockets (610, 615) rotate together.

16. The natural assist simulated gait therapy adjustment system (500) of claim 15, wherein the coupling member (665, 670) comprises a right hand crank (665) and a left hand crank (670) operable to rotate the first and second drive sprockets (610, 615) in response to rotation of the right and left hand cranks (665, 670).

17. A natural assist simulated gait therapy adjustment system (500) comprising:

a seat base (510);

a seat (520) supported by the seat base (510) via a posture positioning system (515) configured to transition between a seated state with a top surface of the seat (520) angled substantially parallel to horizontal, and a standing state with the top surface of the seat (520) angled substantially parallel to vertical; and, means for simulating a natural gait of a user (530*c*), wherein:

during a transition from the seated state to the standing state, the seat (520) articulates upward and forward while increasing an angle of the top surface of the seat (520) with respect to horizontal from substantially 0 degrees in the seated state to substantially 90 degrees in the standing state, and the posture positioning system (515) is a scissor linkage system comprising:

a first base link (540) pivotably coupled to the seat base (510);

a second base link (550) pivotably coupled to the seat base (510);

a first seat link (545) pivotably coupled to the first base link (540), the second base link (550), and a bottom of the seat (520);

a second seat link (560) pivotably coupled to the bottom of the seat (520); and, an intermediary link (555) that operably couples the first seat link (545) to the second seat link (560).

18. The natural assist simulated gait therapy adjustment system (500) of claim 17, further comprising an actuator (530) coupled at a proximal end to the seat base (510), and coupled at a distal end to the first base link (540), such that articulation of the actuator (530) modifies an elevation of the seat (520).

* * * * *